US006664016B2

(12) United States Patent
Kanbayashi et al.

(10) Patent No.: US 6,664,016 B2
(45) Date of Patent: Dec. 16, 2003

(54) MAGENTA TONER

(75) Inventors: Makoto Kanbayashi, Shizuoka (JP); Takaaki Kotaki, Shizuoka (JP); Katsumi Kondo, Ibaraki (JP); Yasuhiro Ichikawa, Shizuoka (JP); Takaaki Kaya, Shizuoka (JP); Wakashi Iida, Shizuoka (JP); Takayuki Itakura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/900,858

(22) Filed: Jul. 10, 2001

(65) Prior Publication Data

US 2002/0037466 A1 Mar. 28, 2002

(30) Foreign Application Priority Data

Jul. 10, 2000 (JP) ..... 2000/208027
Jun. 28, 2001 (JP) ..... 2001/196746

(51) Int. Cl.[7] ..... G03G 9/09
(52) U.S. Cl. ..... 430/108.23; 430/108.3; 430/109.3; 430/109.4
(58) Field of Search ..... 430/108.23, 109.3, 430/109.4, 108.3

(56) References Cited

U.S. PATENT DOCUMENTS

| | | | | |
|---|---|---|---|---|
| 4,301,355 A | | 11/1981 | Kimbrough et al. | 219/137 |
| 4,312,932 A | | 1/1982 | Hauser et al. | 430/45 |
| 4,400,515 A | | 8/1983 | Fuchs et al. | 546/57 |
| 4,777,105 A | | 10/1988 | Macholdt et al. | 430/109 |
| 4,845,003 A | * | 7/1989 | Kiriu et al. | 430/108.23 |
| 4,921,771 A | | 5/1990 | Tomono et al. | 430/110 |
| 5,262,264 A | | 11/1993 | Shimizu et al. | 430/106 |
| 5,332,636 A | * | 7/1994 | Ong | 430/108.23 |
| 5,384,224 A | | 1/1995 | Tanikawa et al. | 430/106 |
| 5,514,511 A | | 5/1996 | Iwamoto et al. | 430/110 |
| 5,547,800 A | | 8/1996 | Nishimori et al. | 430/110 |

(List continued on next page.)

FOREIGN PATENT DOCUMENTS

| | | | | |
|---|---|---|---|---|
| EP | 0890883 A | * | 1/1999 | |
| EP | 1184730 A2 | * | 3/2002 | G03G/9/09 |
| GB | 2059618 | | 4/1981 | |
| JP | 52 3304 | | 1/1977 | |
| JP | 52 3305 | | 1/1977 | |
| JP | 55 84250 | | 6/1980 | |

(List continued on next page.)

OTHER PUBLICATIONS

CRC Handbook of Chemistry & Physics. Boca Raton: CRC Press, Inc. (1985) pp. F–302.*
Grant, Roger et al. Chemical Dictionary. New York: McGraw–Hill, Inc. (1987) pp. 172, 173, 198.*
Patent Abstracts of Japan, vol. 14, No. 301 (P–1069) 1990 for JP 02–096183.

*Primary Examiner*—Christopher RoDee
(74) *Attorney, Agent, or Firm*—Fitzpatrick, Cella, Harper & Scinto

(57) ABSTRACT

A magenta toner having a storage elastic modulus at 80° C., $G'_{80}$, from $1\times10^6$ dN/m$^2$ to $1\times10^8$ dN/m$^2$ and a storage elastic modulus at 120° C. to 180° C., $G'_{120\text{-}180}$, from $2\times10^3$ dN/m$^2$ to $1\times10^6$ dN/m$^2$, and containing a compound represented by Formulas (1) and (2) and a compound represented by Formula (3):

(1)

wherein $R_D2$ represents H or $OCH_3$, $R_D4$ represents H or $CONH_2$, $R_D5$ represents H, $SO_2N(C_2H_5)_2$, $CONHC_6H_5$, $CONH_2$ or $CONHC_6H_4$-(p)$CONH_2$, $R_K2$ represents H, $OCH_3$, $CH_3$ or $OC_2H_5$, $R_K4$ represents H, $OCH_3$ or Cl, and $R_K5$ represents H, $OCH_3$, Cl or $NO_2$;

(2)

wherein $R_D2$ represents H or $SO_3$—, $R_D4$ represents H, Cl or $CH_3$, $R_D5$ represents H, Cl, $CH_3$, $C_2H_5$, or $SO_3$—, and M represents Ba, Ca, Sr, Mn or Mg; provided that one of $R_D2$ and $R_D5$ is $SO_3$.

(3)

wherein $R_D1$ and $R_D2$ each represent H or $CH_3$.

61 Claims, 2 Drawing Sheets

U.S. PATENT DOCUMENTS

| | | | | | |
|---|---|---|---|---|---|
| 5,578,408 | A | | 11/1996 | Kohtaki et al. | 430/106.6 |
| 5,707,771 | A | | 1/1998 | Matsunaga et al. | 530/110 |
| 5,744,276 | A | | 4/1998 | Ohno et al. | 430/109 |
| 5,912,099 | A | | 6/1999 | Kanbayashi et al. | 430/106 |
| 5,955,234 | A | | 9/1999 | Matsunaga et al. | 430/110 |
| 6,002,903 | A | | 12/1999 | Hayase et al. | 399/279 |
| 6,159,649 | A | * | 12/2000 | Macholdt et al. | 430/108.23 |
| 6,455,215 | B1 | * | 9/2002 | Hashimoto et al. | 430/108.23 |
| 2002/0006564 | A1 | * | 1/2002 | Kondou et al. | 430/108.23 |
| 2002/0051924 | A1 | * | 5/2002 | Iida et al. | 430/108.3 |
| 2002/0172880 | A1 | * | 11/2002 | Takayanagi et al. | 430/108.23 |

FOREIGN PATENT DOCUMENTS

| | | | | |
|---|---|---|---|---|
| JP | 57 52574 | | | 3/1982 |
| JP | 57 54954 | | | 4/1982 |
| JP | 62 291669 | | | 12/1987 |
| JP | 63173066 | A | * | 7/1988 |
| JP | 64 9466 | | | 1/1989 |
| JP | 1 142559 | | | 6/1989 |
| JP | 1 154161 | | | 6/1989 |
| JP | 185660 | | | 7/1989 |
| JP | 1 185661 | | | 7/1989 |
| JP | 1 185662 | | | 7/1989 |
| JP | 1 185663 | | | 7/1989 |
| JP | 1 238672 | | | 9/1989 |
| JP | 4 107467 | | | 4/1992 |
| JP | 4 149559 | | | 5/1992 |
| JP | 4 301853 | | | 10/1992 |
| JP | 5 61238 | | | 3/1993 |
| JP | 5 249735 | | | 9/1993 |
| JP | 7 92737 | | | 4/1995 |
| JP | 7 234542 | | | 9/1995 |
| JP | 7 295298 | | | 11/1995 |
| JP | 8 54750 | | | 2/1996 |
| JP | 8 234480 | | | 9/1996 |
| JP | 8 278662 | | | 10/1996 |
| JP | 09179348 | A | * | 7/1997 |
| JP | 10 171156 | | | 6/1998 |
| JP | 10312088 | A | * | 11/1998 |
| JP | 2000 181144 | | | 6/2000 |
| JP | 2000191935 | A | * | 7/2000 |

* cited by examiner

MAGENTA TONER

BACKGROUND OF THE INVENTION

1. Field of the Invention

This invention relates to a magenta toner used in the formation of images by development of electrostatic latent image or by toner jetting. More particularly, it relates to a magenta toner that can exhibit high minuteness even with use of heat-and-pressure fixing means in which any oil for preventing high-temperature offset is not used or such an oil is used in a small quantity.

2. Related Background Art

In recent years, commonly used in full-color copying machines proposed are a method in which, using four photosensitive members and a belt-like transfer member, electrostatic latent images formed respectively on the photosensitive members are developed with a cyan toner, a magenta toner, a yellow toner and a black toner to form corresponding toner images and then a transfer medium is so transported as to be held between the photosensitive members and the belt-like transfer member to transfer the toner images thereto in straight pass, followed by fixing to form a full-color image thereon, and a method in which the transfer medium is wound around the surface of a cylindrical transfer member set opposingly to a photosensitive member, by the aid of electrostatic force or mechanical action of a gripper or the like, and the steps of development and transfer are carried out four times, followed by fixing to form a full-color image thereon.

As toners used in such full-color copying machines, the toners are required to be well color-mixed in the step of heat-and-pressure fixing, without damaging any color reproducibility and any transparency of overhead projection (OHP) images. Compared with ordinary black toners for black-and-white copying machines, toners for full-color images may preferably make use of low-molecular-weight binder resins having sharp-melt properties. However, usually, the use of such binder resins having sharp-melt properties tends to cause a problem on high-temperature anti-offset properties because of a low self-cohesive force of the binder resins when the toners melt in the step of heat-and-pressure fixing. In ordinary black toners for black-and-white copying machines, relatively highly crystalline waxes as typified by polyethylene wax and polypropylene wax are used as release agents in order to improve high-temperature anti-offset properties at the time of fixing. For example, these are disclosed in Japanese Patent Publication No. 52-3304 and No. 52-3305 and Japanese Patent Application Laid-open No. 57-52574. In the toners for full-color images, such release agents may inhibit transparency when images are projected by OHP, because of their high crystallizability and a difference in refractive index between them and materials of OHP sheets, so that the projected images may have low saturation (chroma) and lightness.

To solve such a problem, toners having a specific storage elastic modulus are proposed. For example, Japanese Patent Applications Laid-open No. 11-84716 and No. 8-54750 disclose toners having a specific storage elastic modulus at 180° C. or 170° C. However, as for color toners required to have both low-temperature fixing performance and high-temperature anti-offset properties, to have a good fixing performance in the heat-and-pressure fixing means in which any oil for preventing high-temperature offset is not used or such an oil is used in a small quantity, and to have a sufficient color mixing performance, the toners may have too low viscosity and also have not been satisfactory in respect of storage stability in a high-temperature environment. Japanese Patent Applications Laid-open No. 5-249735, No. 7-92737, No. 7-234542, No. 7-295298, No. 8-234480, No. 8-278662 and No. 10-171156 also disclose toners having specific storage elastic moduli. However, in order to attain fixing performance, storage stability and OHP transparency which are ideal for color toners, there has been room for improvement.

To solve the above problem, as disclosed in Japanese Patent Applications Laid-open No. 4-149559 and No. 4-107467, a method is proposed in which a nucleating agent is used in combination with a wax so as to lower the crystallizability of the wax. As also disclosed in Japanese Patent Applications Laid-open No. 4-301853 and No. 5-61238, a method is proposed in which a wax having a low crystallinity is used. As waxes having a relatively good transparency and a low melting point, montan type waxes are available. Use of montan type waxes is disclosed in Japanese Patent Applications Laid-open No. 1-185660, No. 1-185661, No. 1-185662, No. 1-185663 and No. 1-238672. These waxes, however, by no means satisfy all the transparency in OHP and the low-temperature fixing performance and high-temperature anti-offset properties at the time of heat-and-pressure fixing.

Accordingly, in usual color toners, an oil such as silicone oil or fluorine oil is applied to heat fixing rollers without adding any release agent as far as possible, so as to achieve an improvement in high-temperature anti-offset properties and OHP transparency. However, fixed images thus obtained have excess oil having adhered to their surfaces. This oil may adhere to photosensitive members to cause contamination or the oil may swell fixing rollers to shorten the lifetime of the fixing rollers. In order not to cause any oil streaks on the fixed images, it is necessary to feed oil onto the fixing roller surface evenly and in a constant quantity. This tends to require fixing assembles having a large size.

Accordingly, in the heat-and-pressure fixing means in which any oil is not used or the oil is used in a small quantity, it is long-awaited to provide a toner having kept offset from occurring and also promising superior transparency of fixed images.

Meanwhile, with an increase in instances in which color copying machines are connected to computers via controllers and used as high-grade color printers, a color management system has come to be proposed which makes color control of the whole system. As the result, specific users have come to strongly demand that the printed images produced by a color printer of an electrophotographic system are identical in tinges with the printed images produced by printing making use of process inks. Thus, there has come to be a demand for toners capable of providing the same color tones as process inks.

Some proposals have ever been made on pigments for magenta toners. In view of superior sharpness and transparency of color and also superior light-fastness, quinacridone pigments have been in wide use.

For example, Japanese Patent Applications Laid-open No. 49-27228, No. 57-54954 and No.1-142559 disclose a toner making use of 2,9-dimethdylquinacridone alone. This toner certainly has a superior light-fastness, but can not be said to be a well vivid magenta toner. Japanese Patent Application Laid-open No. 64-9466 discloses that a quinacridone pigment and a xanthene dye or a pigment obtained by making a xanthene dye into a lake are used in combination so as to improve the vividness of toners. This toner has not attained a sufficient vividness, and has had a problem that it changes in color and images formed may change in color when left over a long time.

Japanese Patent Application Laid-open No. 1-154161 discloses use of a quinacridone pigment of 0.5 $\mu$m or smaller average particle diameter in an attempt to improve the transparency of magenta toners. The transparency of toners depends on pigments, resins and how and to what extent the pigments are dispersed in resins, and any magenta toners having a high transparency have not necessarily been obtained.

Meanwhile, in the case of full-color images, colors are reproduced using three chromatic toners consisting of three-primary-color coloring materials, a yellow toner, a magenta toner and a cyan toner, or four color toners consisting of these toners and a black toner added thereto. In order to obtain images having the intended color tones, the balancing of different colors is important, and it is also attempted to a little change the color tone of the magenta toner.

For example, Japanese Patent Publication No. 63-18628 discloses a mixture of compounds which contains two types of substituted quinacridones. Japanese Patent Application Laid-open No. 62-291669 discloses use of a mixed crystal of 2,9-dimethylquinacridone and unsubstituted quinacridone as a magenta colorant, which is proposed as a colorant having the intended hue and also aiming at an improvement in triboelectric charging performance of toners.

Its color tone has more shifted toward a tinge of yellow as a whole than the case of the sole use of 2,9-dimethylquinacridone. However, it tinges strongly with blue compared with the hue of magenta inks for offset printing. Thus, there have remained many points to be improved.

Japanese Patent Application Laid-open No. 2000-181144 discloses an image-recording coloring composition of vivid magenta color in which a dimethylquinacridone pigment and a red pigment are used in combination. However, according to studies made by us, there still is room for further improvement in respect of anti-offset properties at the time of continuous fixing, and the composition is not on the level satisfactory as toners for oilless fixing.

SUMMARY OF THE INVENTION

An object of the present invention is to provide a magenta toner having solved the problems discussed above.

More specifically, an object of the present invention is to provide a magenta toner having superior low-temperature fixing performance.

Another object of the present invention is to provide a magenta toner having superior storage stability, heat resistance and anti-blocking properties.

Still another object of the present invention is to provide a magenta toner which has a high coloring power that covers a broad dynamic range of from low density to high density, affords high saturation and lightness, affords superior OHP transparency, enables superior dispersion of colorants, promises a high light-fastness and also have a color tone agreeing with the magenta of process inks.

A further object of the present invention is to provide a magenta toner which can exhibit good fixing performance and color mixing performance, has a sufficient triboelectric chargeability, affords glossiness high enough to improve image quality, can well prevent high-temperature offset, has a broad fixable temperature range, has been kept from causing melt adhesion of toner to the interior of developing assembly, i.e., parts such as a sleeve, a blade and a coating roller, also shows a good cleaning performance, and has been kept from causing filming to the photosensitive member surface.

A still further object of the present invention is to provide a magenta toner which has been kept from causing fog, has a superior highlight reproducibility, promises a solid-image uniformity, and has a superior running stability.

To achieve the above objects, the present invention provides a magenta toner containing at least a binder resin and a colorant, wherein;

the magenta toner has a storage elastic modulus at a temperature of 80° C., $G'_{80}$, in the range of from $1\times10^6$ dN/m$^2$ to $1\times10^8$ dN/m$^2$ and a storage elastic modulus at a temperature of from 120° C. to 180° C., $G'_{120\text{-}180}$, in the range off $2\times10^3$ dN/m$^2$ to $1\times10^6$ dN/m$^2$; and the magenta toner contains at least i) at least one compound selected from the group consisting of compounds represented by the following Formulas (1) and (2) and ii) a compound represented by the following Formula (3):

(1)

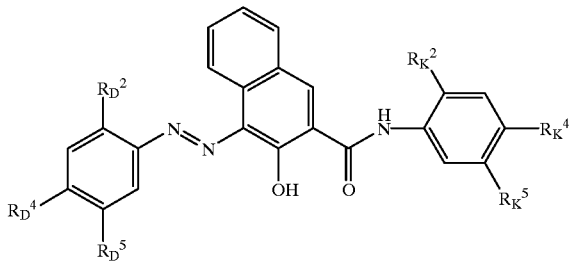

wherein $R_D2$ represents H or $OCH_3$, $R_D4$ represents H or $CONH_2$, $R_D5$ represents H, $SO_2N(C_2H_5)_2$ $CONHC_6H_5$, $CONH_2$ or $CONHC_6H_4$-(p)$CONH_2$, $R_K2$ represents H, $OCH_3$, $CH_3$ or $OC_2H_5$, $R_K4$ represents H, $OCH_3$ or Cl, and $R_K5$ represents H, $OCH_3$, Cl or $NO_2$;

(2)

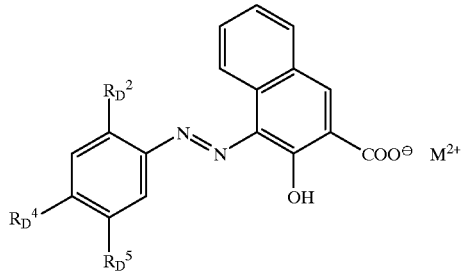

wherein $R_D2$ represents H or $SO_{3-}$, $R_D4$ represents H, Cl or $CH_3$, $R_D5$ represents H, Cl, $CH_3$, $C_2H_5$ or $SO_{3-}$, and M represents Ba, Ca, Sr, Mn or Mg; provided that one of $R_D2$ and $R_D5$ is $SO_3^-$;

(3)

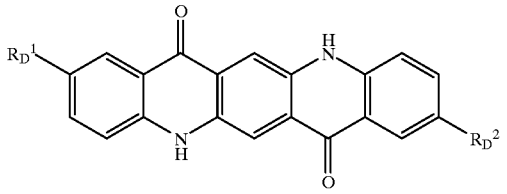

wherein $R_D1$, and $R_D2$ each represent H or $CH_3$.

DETAILED DESCRIPTION OF THE PREFERRED EMBODIMENTS

Figure 1:
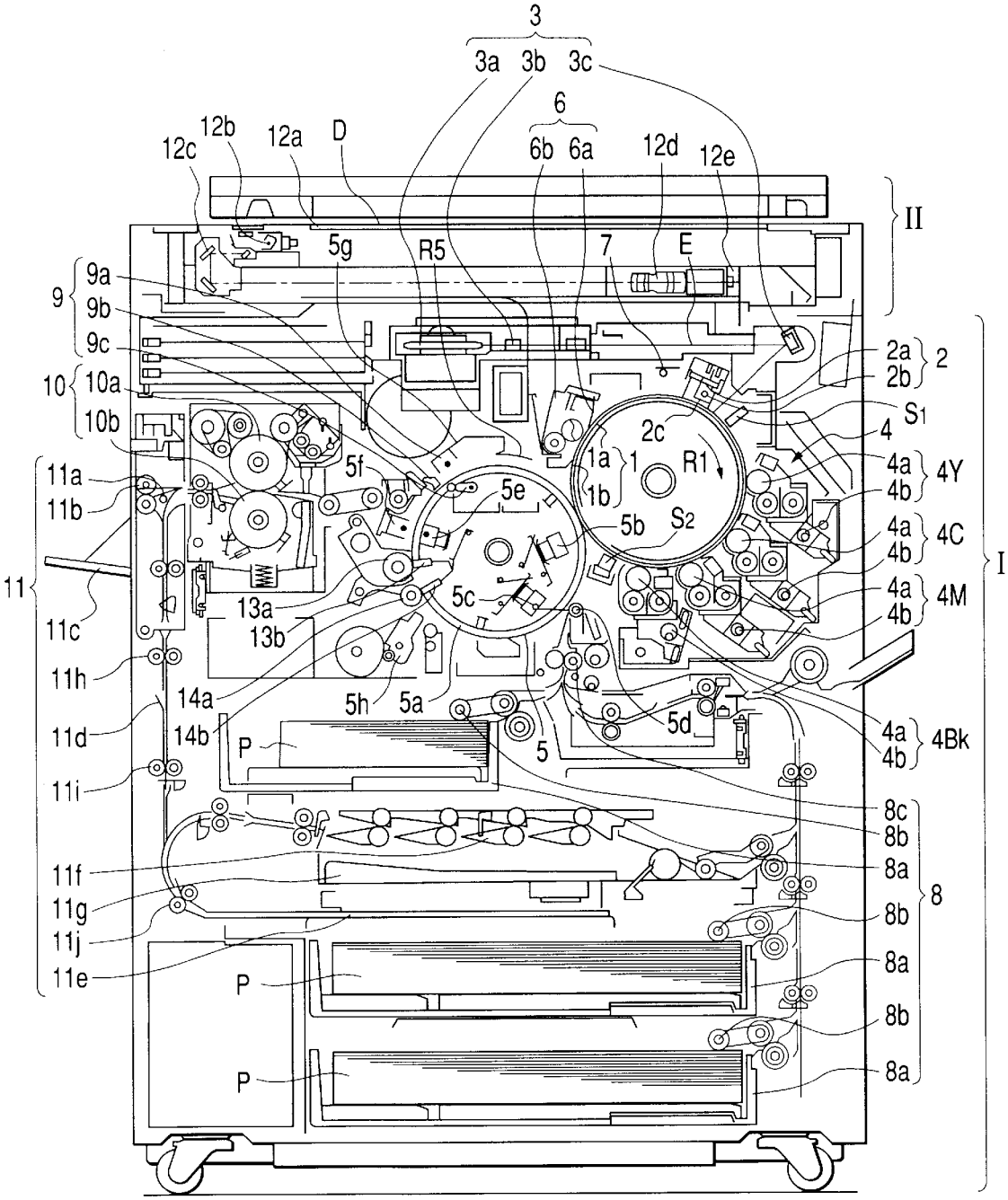
FIG. 1 illustrates a specific example of an image-forming apparatus in which the magenta toner of the present invention is used.

As a result of extensive studies, the present inventors have discovered that, in order for a toner to have superior high-temperature anti-offset properties and also achieve both long-term storage stability and low-temperature fixing performance in a high-temperature environment even in the heat-and-pressure fixing means in which any oil is not used or the oil is used in a small quantity, it is effective for the toner to fulfill the requirements set out in the above summary, and also that, in order to obtain a magenta toner promising a high light-fastness and having a good color tone, i) at least one compound selected from the group consisting of compounds represented by Formulas (1) and (2) and ii) a compound represented by Formula (3) as shown in the above summary may be mixed in a prescribed proportion and dispersed in the toner, whereby a superior dispersion of pigments and a high OHP transparency can be attained.

The magenta toner of the present invention will be described below in detail.

First, the magenta toner of the present invention has a storage elastic modulus at a temperature of 80° C., $G'_{80}$, in the range of from $1\times10^6$ to $1\times10^8$ dN/m$^2$, preferably from $1\times10^6$ to $9\times10^7$ dN/m$^2$, and more preferably from $2\times10^6$ to $9\times10^7$ dN/m$^2$. Where the toner fulfills this requirement, the toner can have good storage stability, heat resistance and anti-blocking properties even in a high-temperature environment. If the toner has a storage elastic modulus $G'_{80}$ lower than $1\times10^6$ dN/m$^2$, it may have inferior storage stability, heat resistance and anti-blocking properties in a high-temperature environment, so that toner particles may coalesce one another to form large agglomerates of toner undesirably. In recent years, copying machines and printers are being made high-speed for their output speed and being made compact in body size, and hence they have a tendency toward higher in-machine temperature. Accordingly, in order to stably obtain images with high minuteness and high image quality, it is important for toners to have sufficient storage stability, heat resistance and anti-blocking properties in a high-temperature environment. Also, if the toner has a storage elastic modulus $G'_{80}$ higher than $1\times10^8$ dN/m$^2$, it can have sufficient storage stability, heat resistance and anti-blocking properties, but may have no sufficient fixing performance at low-temperature undesirably.

The magenta toner of the present invention also has a storage elastic modulus at a temperature of from 120° C. to 180° C., $G'_{120\text{-}180}$, in the range of from $2\times10^3$ to $1\times10^6$ dN/m$^2$, preferably from $5\times10^3$ to $1\times10^6$ dN/m$^2$, and more preferably from $5\times10^3$ to $5\times10^5$ dN/m$^2$. Where the toner fulfills this requirement, both sufficient fixing performance and sufficient high-temperature anti-blocking properties can be achieved, and also images having a good gloss can be obtained. If the toner has a storage elastic modulus $G'_{120\text{-}180}$ lower than $2\times10^3$ dN/m$^2$, the toner can not have any sufficient high-temperature anti-offset properties undesirably. Also, if the toner has a storage elastic modulus $G'_{120\text{-}180}$ higher than $1\times10^6$ dN/m$^2$, the toner can not sufficiently be fixed, resulting in a greatly low color developability. The toner may preferably have a storage elastic modulus at a temperature of 120° C., $G'_{120}$, in the range of from $1\times10^4$ to $8\times10^5$ dN/m$^2$, and a storage elastic modulus at a temperature of 180° C., $G'_{180}$, in the range of from $5\times10^3$ to $5\times10^5$ dN/m$^2$.

The magenta toner of the present invention exhibits much better anti-offset properties when the storage elastic modulus at a temperature of from 120° C. to 180° C., $G'_{120\text{-}180}$, has a minimum value G'min and a maximum value G'max in a ratio G'max/G'min of 20 or lower. If the ratio G'max/G'min is higher than 20, fixed images may have a different gloss depending on the fixing temperature. This is undesirable in view of stable formation of images in a high quality level when images are reproduced in a large quantity. The ratio G'max/G'min may more preferably be 15 or lower.

The magenta toner of the present invention contains at least a binder resin and a colorant.

The binder resin used in the toner of the present invention may preferably be a resin selected from any of (a) a polyester resin, (b) a hybrid resin having a polyester unit and a vinyl copolymer unit, (c) a mixture of the hybrid resin and a vinyl copolymer and (d) a mixture of the hybrid resin and a polyester resin, where, in molecular weight distribution as measured by gel permeation chromatography (GPC) of the resin component, the binder resin may preferably have a main peak in the region of molecular weight of from 3,500 to 10,000, and preferably in the region of molecular weight of from 4,000 to 9,000, and have a ratio of Mw (weight-average molecular weight) and Mn (number-average molecular weight), Mw/Mn, of 5.0 or higher. If the binder resin has a main peak in the region of molecular weight less than 3,500, the toner may have insufficient anti-offset properties. If on the other hand it has a main peak in the region of molecular weight more than 10,000, the toner can not have any sufficient low-temperature fixing performance and also may afford insufficient OHP transparency. If the toner has an Mw/Mn lower than 5.0, it may be difficult to attain good anti-offset properties.

In the case when a polyester resin is used as the binder resin, alcohols and carboxylic acids or carboxylic anhydrides or carboxylates may be used as material monomers. Stated specifically, as a dihydric alcohol component, it may include, e.g., bisphenol-A alkylene oxide addition products such as polyoxypropylene(2.2)-2,2-bis(4-hydroxyphenyl) propane, polyoxypropylene(3.3)-2,2-bis(4-hydroxyphenyl) propane, polyoxyethylene(2.0)-2,2-bis(4-hydroxyphenyl) propane, polyoxypropylene(2.0)-polyoxyethylene(2.0)-2,2-bis(4-hydroxyphenyl)propane and polyoxypropylene(6)-2,2-bis(4-hydroxyphenyl)propane; and ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A and hydrogenated bisphenol A.

As a trihydric or higher alcohol component, it may include, e.g., sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

As an acid component, it may include aromatic dicarboxylic acids such as phthalic acid, isophthalic acid and terephthalic acid, or anhydrides thereof; alkyldicarboxylic acids such as succinic acid, adipic acid, sebacic acid and azelaic acid, or anhydrides thereof; succinic acids substituted with an alkyl group having 6 to 12 carbon atoms, or anhydrides thereof; unsaturated dicarboxylic acids such as fumaric acid, maleic acid and citraconic acid, or anhydrides thereof.

In particular, a polyester resin having as a diol component a bisphenol derivative represented by the following Formula (4) and as an acid component a carboxylic acid comprised of a dibasic or higher carboxylic acid or an acid anhydride thereof or a lower alkyl ester thereof (e.g., fumaric acid, maleic acid, maleic anhydride, phthalic acid, terephthalic acid, trimellitic acid or pyromellitic acid), and obtained by polycondensation of these components is preferred because it affords a good charging performance for color toners.

(4)

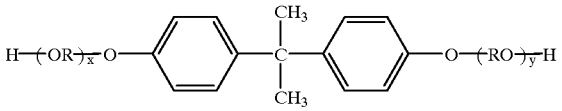

wherein R represents an ethylene group or a propylene group, x and y are each an integer of 0 or more, and an average value of x+y is 2 to 10;

In the case when the hybrid resin having a polyester unit and a vinyl copolymer unit is used as the binder resin, much better improvements in wax dispersion, low-temperature fixing performance and high-temperature anti-offset properties can be expected. The "hybrid resin" termed in the present invention is meant to be a resin in which, as components, vinyl copolymer units and polyester units have chemically been bonded. Stated specifically, it is formed by ester exchange reaction of a polyester unit with a vinyl copolymer unit made up by polymerizing a monomer having a carboxylate group such as acrylate or methacrylate, which may preferably form a graft copolymer (or block copolymer) comprised of vinyl copolymer unit as the backbone polymer and the polyester unit as the branch polymer.

As a vinyl monomer for forming the vinyl copolymer unit (vinyl resin), it may include the following: Styrene; styrene derivatives such as o-methylstyrene, m-methylstyrene, p-methylstyrene, α-methylstyrene, p-phenylstyrene, p-ethylstyrene, 2,4-dimethylstyrene, p-n-butylstyrene, p-tert-butylstyrene, p-n-hexystyelene, p-n-octystyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene; ethylene unsaturated monoolefins such as ethylene, propylene, butylene and isobutylene; unsaturated polyenes such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide.

It may further include monomers having carboxyl groups exemplified by unsaturated dibasic acids such as maleic acid, citraconic acid, itaconic acid, alkenylsuccinic acids, fumaric acid and mesaconic acid; unsaturated dibasic acid anhydrides such as maleic anhydride, citraconic anhydride, itaconic anhydride and alkenylsuccinic anhydrides; half esters of unsaturated dibasic acids, such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; unsaturated dibasic esters such as dimethyl maleate and dimethyl fumarate; α,β-unsaturated acids such as acrylic acid, methacrylic acid, crotonic acid and cinnamic acid; α,β-unsaturated acid anhydrides such as crotonic anhydride and cinnamic anhydride; anhydrides of the α,β-unsaturated acids with lower fatty acids; and alkenylmalonic acids, alkenylglutaric acids, alkenyladipic acids, acid anhydrides of these and monoesters of these.

It may still further include monomers having hydroxyl groups as exemplified by acrylates or methacrylates such as 2-hydroxyethyl acrylate, 2-hydroxyethyl methacrylate and 2-hydroxypropyl methacrylate; and 4-(1-hydroxy-1-methylbutyl)styrene and 4-(1-hydroxy-1-methylhexyl) styrene.

In the magenta toner of the present invention, the vinyl copolymer unit of the binder resin may have a cross-linked structure, cross-linked with a cross-linking agent having at least two vinyl groups. The cross-linking agent used in such a case may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether linkage, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moiety has been replaced with methacrylate; diacrylate compounds linked with a chain containing an aromatic group and an ether linkage, as exemplified by polyoxythylene(2)-2,2-bis(4-hydroxyphenyl)propane diacrylate, polyoxythylene(4)-2,2-bis(4-hydroxyphenyl) propane diacrylate, and the above compounds whose acrylate moiety has been replaced with methacrylate.

As a polyfunctional cross-linking agent, it may include pentaerythritol triacrylate, trimethylolethane triacrylate, trimethylolpropane triacrylate, tetramethylolpropane triacrylate, tetramethylolmethane tetraacrylate, oligoester acrylate, and the above compounds whose acrylate moiety has been replaced with methacrylate; triallylcyanurate, and triallyltrimellitate.

In the present invention, the vinyl copolymer component (vinyl resin) and/or the polyester resin component may preferably be incorporated with a monomer component capable of reacting with the both resin components. Among monomers constituting the polyester resin component, a monomer component capable of reacting with the vinyl copolymer component may include, e.g., unsaturated dicarboxylic acids such as fumaric acid, maleic acid, citraconic acid and itaconic acid, or anhydrides thereof. Among monomers constituting the vinyl copolymer component, a monomer component capable of reacting with the polyester resin component may include monomers having a carboxyl group or a hydroxyl group, and acrylates or methacrylates.

As a method for obtaining a reaction product of the vinyl copolymer component with the polyester resin component, preferred is a method in which, in the state the above monomer components capable of respectively reacting with the vinyl copolymer component and the polyester resin component are present, polymerization reaction for any one or both of the resins is carried out.

As a polymerization initiator used when the vinyl copolymer according to the present invention is used, it may include, e.g., azo or diazo types such as 2,2'-azobisisobutyronitrile, 2,2'-azobis-(4-methoxy-2,4-dimethylvaleronitrile), 2,2'-azobis-(2,4-dimethylvaleronitrile), 2,2'-azobis-(2-methylbutyronitrile), dimethyl-2,2'-azobisisobutyrate, 1,1'-azobis-(1-cyclohexane-1-carbonitrile), 2-(carbamoylazo) isobutyronitrile, 2,2'-azobis-(2,4,4-trimethylpentane), 2-phenylazo-2,4-dimethyl-4-methoxyvaleronitrile and 2,2'-azobis-(2-methyl-propane); ketone peroxides such as methyl ethyl ketone peroxide, acetylacetone peroxide and cylcohexanone peroxide; and other types such as 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, di-cumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, di-isopropyl peroxydicarbonate, di-2-ethylhexyl peroxydicarbonate, di-n-propyl peroxydicarbonate, di-2-ethoxyethyl peroxydicarbonate, di-methoxyisopropyl peroxydicarbonate, di(3-methyl-3-methoxybutyl) peroxydicarbonate, acetylcylohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxylbenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydrophthalate and di-t-butyl peroxyazelate.

As methods by which the hybrid resin used in the magenta toner of the present invention can be produced may include, e.g., the following production methods shown in (1) to (5).

(1) The hybrid resin is produced by reacting a vinyl copolymer unit (a vinyl monomer may optionally be added) with a polyester monomer (alcohol, carboxylic acid) and/or a polyester. In this case, any organic solvent may appropriately be used.

(2) The hybrid resin is produced by reacting a polyester unit (a polyester monomer may optionally be added) with a vinyl monomer and/or a vinyl copolymer unit.

(3) A vinyl copolymer unit and a polyester unit are first produced, and thereafter in the presence of these polymer units a vinyl monomer and/or a polyester monomer (alcohol, carboxylic acid) is/are added to produce the hybrid resin. In this case, too, any organic solvent may appropriately be used.

(4) A hybrid resin is first produced and thereafter a vinyl monomer and/or a polyester monomer (alcohol, carboxylic acid) is/are added to effect addition polymerization and/or polycondensation reaction to produce a vinyl copolymer unit and a polyester unit. In this case, as the hybrid resin, any of the hybrid resins produced by the above methods (1) to (3) may be used, or optionally a hybrid resin produced by any conventional method may also be used. Also, any organic solvent may appropriately be used.

(5) A vinyl monomer and a polyester monomer (alcohol, carboxylic acid) are mixed to effect addition polymerization and polycondensation reaction continuously to produce the hybrid resin. Also, any organic solvent may appropriately be used.

In the above production processes (1) to (5), a plurality of polymer units having different molecular weights and different degrees of cross-linking may be used as the vinyl copolymer unit and/or the polyester unit.

As the binder resin contained in the magenta toner of the present invention, a resin selected from any of a polyester resin, a hybrid resin having a polyester unit and a vinyl copolymer unit, a mixture of the hybrid resin and a vinyl copolymer and a mixture of the hybrid resin and a polyester resin may be used as described above.

The binder resin contained in the magenta toner of the present invention may preferably have a glass transition temperature of from 40 to 90° C., and more preferably from 45 to 85° C. The binder resin may preferably have an acid value of from 1 to 40 mg·KOH/g.

A wax which may be used in the present invention is described below.

The magenta toner of the present invention may preferably contain at least one type of wax. From the viewpoint of achievement of both the low-temperature fixing performance and the anti-blocking properties, the magenta toner of the present invention may preferably have, in the endothermic curve in the measurement by differential thermal analysis (or differential scanning calorimetry DSC), one or a plurality of endothermic peak(s) in the range of temperature of from 30 to 200° C., and a peak temperature of the maximum endothermic peak in the endothermic peaks, in the range of from 60 to 110° C. It may more preferably have the maximum peak of the endothermic curve in the range of temperature of from 65 to 100° C. If the peak temperature of the maximum endothermic peak is lower than 60° C., the toner may have poor anti-blocking properties. If on the other hand the peak temperature of the maximum endothermic peak is higher than 110° C., the toner may have a low fixing performance.

As examples of the wax used in the present invention, it may include the following: aliphatic hydrocarbon waxes such as low-molecular weight polyethylene, low-molecular weight polypropylene, microcrystalline wax and paraffin wax, oxides of aliphatic hydrocarbon waxes, such as polyethylene oxide wax, or block copolymers of these; waxes composed chiefly of a fatty ester, such as carnauba wax, sazol wax and montanate wax, or those obtained by subjecting part or the whole of fatty esters to deoxidizing treatment, such as dioxidized carnauba wax. It may further include saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; fatty acid amides such as linolic acid amide, oleic acid amide and lauric acid amide; saturated fatty acid bisamides such as methylenebis(stearic acid amide), ethylenebis(capric acid amide), ethylenebis(lauric acid amide) and hexamethylenebis(stearic acid amide); unsaturated fatty acid amides such as ethylenebis(oleic acid amide), hexamethylenebis(oleic acid amide), N,N'-dioleyladipic acid amide and N,N'-dioleylsebasic acid amide; aromatic bisamides such as such as m-xylenebisstearic acid amide, N,N'-distearylisophthalic acid amide; fatty acid metal salts (those commonly called metal soap) such as calcium stearate, calcium laurate, zinc stearate and magnesium stearate; grafted waxes obtained by grafting vinyl monomers such as styrene or an acrylic acid to fatty acid hydrocarbon waxes; partially esterified products of polyhydric alcohols with fatty acids, such as monoglyceride behenate; and methyl esterified product having a hydroxyl group, obtained by hydrogenation of vegetable fats and oils.

The waxes particularly preferably usable in the present invention may include aliphatic hydrocarbon waxes. For example, they may be low-molecular weight alkylene polymers obtained by polymerizing alkylenes by radical polymerization under high pressure or by polymerization under low pressure in the presence of a Ziegler catalyst, alkylene polymers obtained by thermal decomposition of high-molecular weight alkylene polymers, and synthetic hydrocarbon waxes obtained from, or by hydrogenation of, distillation residues of hydrocarbons obtained by the Arge process from synthetic gases comprised of carbon monoxide and hydrogen. Hydrocarbon waxes fractionated by using press sweating, solvent fractionation or vacuum distillation, or by a fractionation recrystallization system may more preferably be used.

The hydrocarbons, serving as a matrix, may include i) those synthesized by reacting carbon monoxide with hydrogen in the presence of a metal oxide type catalyst (usually catalysts of a two or more multiple system), as exemplified by hydrocarbons obtained by the Synthol method or the Hydrocol process (making use of a fluidized catalyst bed), ii) hydrocarbons having up to about sveral humdred carbon atoms obtained by the Arge process (making use of a fixed catalyst bed) which can obtain waxy hydrocarbons in a large quantity, and iii) hydrocarbons obtained by polymerization of alkylenes such as ethylene in the presence of a Ziegler catalyst, all of which are preferable as having less and small branches and being saturated long straight chain hydrocarbons. In particular, waxes synthesized by the method not relying on the polymerization of alkylenes are preferred in view of their molecular weight distribution.

The wax may preferably have, in its molecular weight distribution, a main peak in the range of molecular weight of from 400 to 2,400, and more preferably in the range of molecular weight of from 430 to 2,000. Waxes made to have such a molecular weight distribution can endow the toner with preferable thermal properties.

In order to make the toner function more effectively at the time of fixing, the wax may preferably have a melting point of from 60 to 110° C., and more preferably from 65 to 100° C.

The wax may be used in an amount of from 0.1 to 20 parts by weight, and preferably from 0.5 to 10 parts by weight, based on 100 parts by weight of the binder resin.

The wax may usually be incorporated into the binder resin by a method in which the resin is dissolved in a solvent and the resin solution formed is heated, where the wax is added and mixed with stirring, or a method in which it is mixed at the time of kneading.

Pigments used in the present invention are described below.

A quinacridone pigment represented by the following Formula (3):

(3)

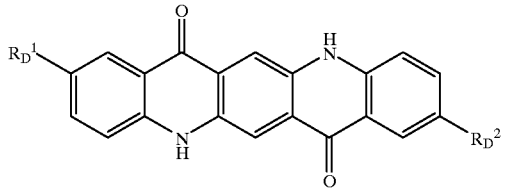

wherein $R_D1$ and $R_D2$ each represent H or $CH_3$; is a pigment having good light-fastness and is a pigment having been used from old times. It shows a vivid magenta color. In particular, 2,9-dimethylquinacridone represented by the following structural formula (3-1) shows a magenta color having high lightness and saturation and high color reproducibility. It, however, has a feature that its color is strongly bluish compared with the color tone of magenta for offset inks.

(3-1)

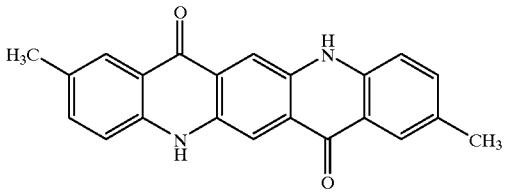

An unsubstituted quinacridone represented by the following structural formula (3-2) is also known to assume α-, β- or γ-type crystal structure. The β-type has a light-fastness superior to that of the α-type; and the γ-type, to the β-type. Meanwhile, the β-type quinacridone and γ-type quinacridone show clear differences in peak patterns in their X-ray diffraction spectra, and also greatly differ in tinges. The β-type quinacridone shows a strong tinge of violet, and the γ-type quinacridone shows a color tone shifting to a tinge of yellow compared with the β-type. In the present invention, the compound represented by the structural formula (3-2) may preferably be the γ-type quinacridone, but is by no means limitative to any particular crystal structure.

(3-2)

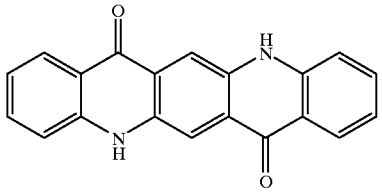

Meanwhile, as magenta pigments for process inks, carmine pigments and naphthol pigments have ever been in wide use. These, however, have a disadvantage that, when applied to toners, they tinge with red so strongly as to have a very narrow reproducibility in blue region. In addition, these pigments commonly have a poor light-fastness, and differ plainly from the quinacridone pigment.

A compound represented by the following Formula (1) is one of a group of pigments called naphthol AS pigments. Also, a compound represented by the following Formula (2) is one of a group of pigments called β-naphthol-type lake pigments. These are pigments used in various fields. Some examples in which these are applied to toners are also reported. These pigments, however, tinge with red too strongly to be suitable as those for full-color images by themselves. However, when used in combination with the pigment represented by Formula (3), the color tone of magenta can be made to agree with the color tone of magenta of process inks.

The present inventors made extensive studies on magenta toners promising a superior light-fastness, affording high lightness and saturation and having a broad color reproducibility and magenta toners agreeing with the hue of magenta of process inks. As the result, they have discovered that a magenta toner having a good hue can be provided when a compound represented by the following Formula (1) or a compound represented by the following Formula (2) and the compound represented by Formula (3) are mixed and uniformly dispersed.

(1)

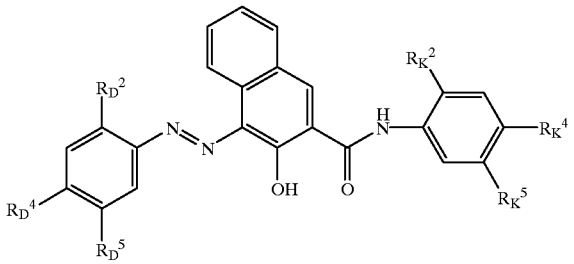

wherein $R_D2$ represents H or $OCH_3$, $R_D4$ represents H or $CONH_2$, $R_D5$ represents H, $SO_2N(C_2H_5)_2$, $CONHC_6H_5$, $CONH_2$ or $CONHC_6H_4$-(p)$CONH_2$, $R_K2$ represents H, $OCH_3$, $CH_3$ or $OC_2H_5$, $R_K4$ represents H, $OCH_3$ or Cl, and $R_K5$ represents H, $OCH_3$, Cl or $NO_2$.

(2)

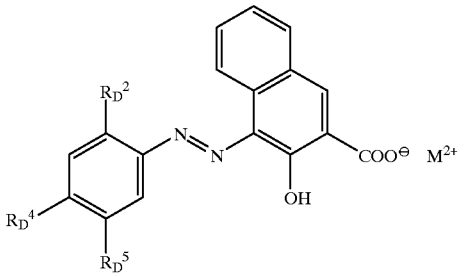

wherein $R_D2$ represents H or $SO_{3-}$, $R_D4$ represents H, Cl or $CH_3$, $R_D5$ represents H, Cl $CH_3$, $C_2H_5$ or $SO_3^-$, and M represents Ba, Ca, Sr, Mn or Mg; provided that one of $R_D2$ and $R_D5$ is $SO_3^-$.

Any pigments other than the compound represented by Formula (1) or Formula (2), even though they can regulate color tinges, are not compatible with the light-fastness. The compounds represented by Formula (1), Formula (2) and Formula (3) have good dispersibility in binder resins desired for the purpose of their use in oilless fixing, and also afford superior OHP transparency.

In the present invention, the compound represented by Formula (1) [compound (1)] and the compound represented by Formula (3) [compound (3)], or the compound represented by Formula (2) [compound (2)] and the compound (3), may preferably be mixed in a weight ratio of from 5:95 to 70:30, and more preferably from 10:90 to 60:40, and still more preferably from 15:85 to 50:50.

If the compound (1) or compound (2) is in a proportion smaller than 5, the control of color tone that is one of the objects of the present invention may insufficiently be made, resulting in a great difference from the color tone of process inks in some cases. If on the other hand the compound (1) or compound (2) is in a proportion larger than 70, the toner may have a low light-fastness. In addition, in the case of full-color images, since colors are reproduced using three colors consisting of coloring materials' three primary colors, yellow, magenta and cyan, or four colors consisting of these colors and black added thereto, the color reproducibility of blue-type colors which are reproducible by subtractive color mixing with cyan may greatly lower undesirably if the color tone of magenta has excessively greatly changed to red color.

In the magenta toner of the present invention, a mixture of the compound (1) and the compound (3) or a mixture of the compound (2) and the compound (3) may preferably be contained in an amount of from 2 to 15 parts by weight, more preferably from 2.5 to 12 parts by weight, and still more preferably from 3 to 10 parts by weight, in total, based on 100 parts by weight of the binder resin.

If the total content of the compound (1) and compound (3) or the total content of the compound (2) and compound (3) is smaller than 2 parts by weight, the toner may have a low coloring power to make it difficult to obtain high-grade images having high image density. If on the other hand it is larger than 15 parts by weight, the toner may have a low transparency to provide a low OHP transparency. In addition, the toner may also have a low reproducibility for intermediate colors as typified by flesh color of humans. Moreover, the toner may also have an unstable charging performance to cause problems such as fog in a low-temperature low-humidity environment and toner scatter in a high-temperature high-humidity environment.

The compound (1), compound (2) and compound (3) each have so good a dispersibility that the compound may less come off from toner particle surfaces and may hardly cause any of various problems such as fog, drum contamination and faulty cleaning. Moreover, when such a toner containing the compound (1) and the compound (3) or containing the compound (2) and the compound (3) is used in two-component developers, it can show a stable charging performance throughout long-term running without causing any problems such as carrier contamination.

The magenta toner of the present invention also promises so good a light-fastness that little change in color or tint may be seen even when a long-term exposure test is made on image samples substantially according to JIS K7102 by means of a commercially available weatherometer.

The compound represented by Formula (1) may preferably be a compound represented by the following structural formula (1-1), (1-2), (1-3), (1-4) or (1-5), and the compound represented by Formula (2) may preferably be a compound represented by the following structural formula (2-1). This is preferable in view of color tone control, stabilization of charge and so forth.

Note, however, that in the present invention the compound represented by Formula (1) or (2) is by no means limited to the following compounds.

(1-1)

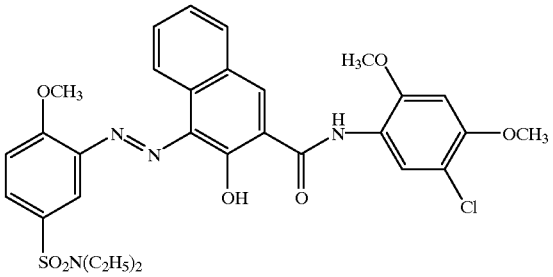

(1-2)

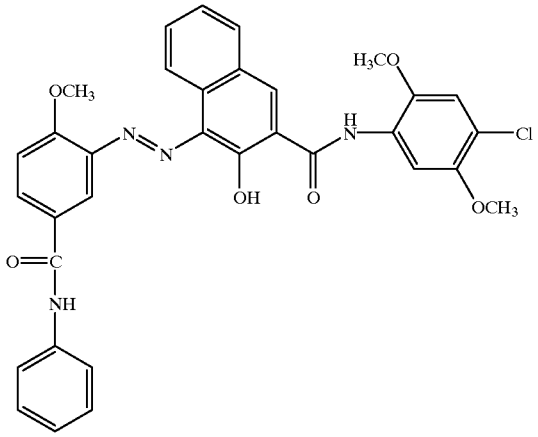

(1-3)

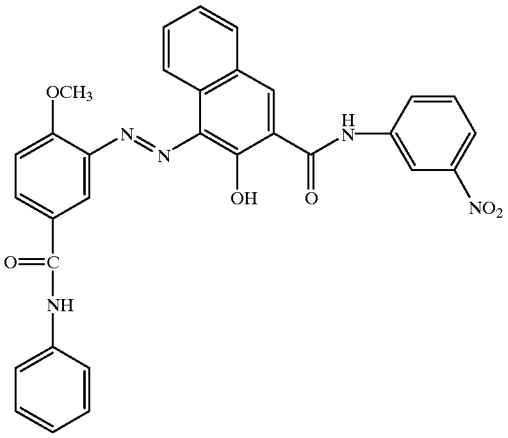

-continued (1-4)

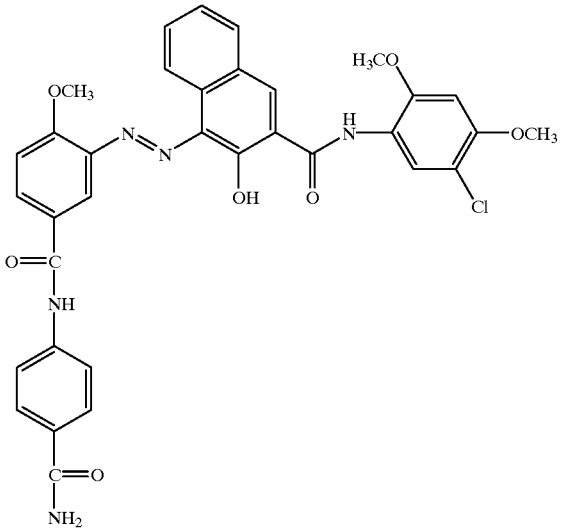

(1-5)

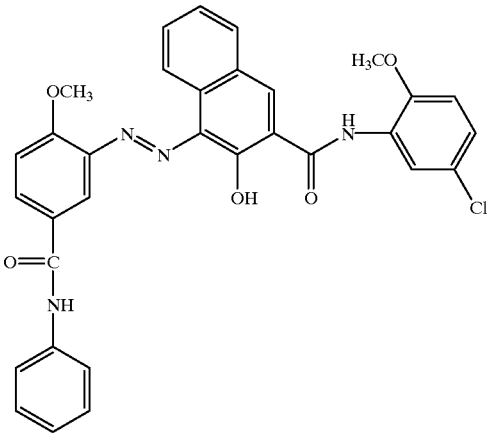

(2-1)

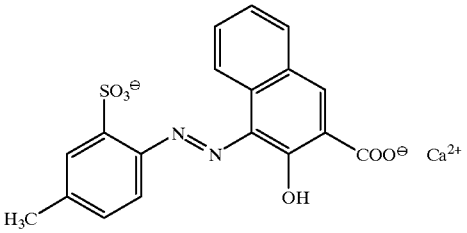

In the magenta toner of the present invention, it may preferably contain as an organometallic compound a metal compound of an aromatic carboxylic acid derivative. Such a compound not only functions as a charge control agent, but also contributes to an improvement in dispersibility of the compounds represented by Formula (1), Formula (2) and Formula (3).

The reason why the metal compound of an aromatic carboxylic acid derivative improves the dispersibility of pigments is uncertain, and is presumed to be due to mutual action between the binder resin and the metal compound of an aromatic carboxylic acid derivative, which action causes cross-linking reaction to proceed partly and makes a large shear act on the coloring material at the time of kneading to bring about an improvement in dispersibility of the compounds of Formulas (1), (2) and (3).

The aromatic carboxylic acid may include the following three compounds (5) to (7).

Compound (5)

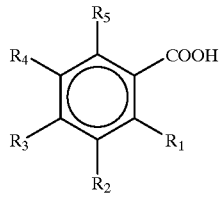

Compound (6)

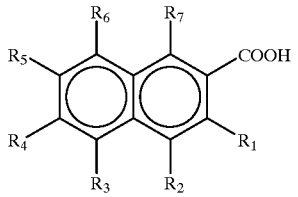

Compound (7)

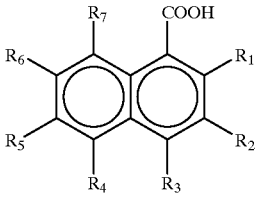

wherein $R_1$ to $R_7$ represent groups which may be the same or different, and each represent a hydrogen atom, an alkyl group having 1 to 12 carbon atoms, an alkenyl group having 2 to 12 carbon atoms, —OH, $—NH_2$, $—NH(CH_3)$, $—N(CH_3)_2$, $—OCH_3$, $—O(C_2H_5)$, —COOH or $—CONH_2$.

Preferred groups represented by $R_1$ may include a hydroxyl group, an amino group and a methoxyl group. In particular, a hydroxyl group is preferred. The aromatic carboxylic acid may particularly preferably be a dialkylsalicylic acid such as di-tert-butylsalicylic acid.

Metals that form such organometallic compounds may include $Mg^{2+}$, $Ca^{2+}$, $Sr^{2+}$, $Pb^{2+}$, $Fe^{2+}$, $Co^{2+}$, $Ni^{2+}$, $Zn^{2+}$, $Cu^{2+}$, $Al^{3+}$, $Cr^{3+}$, $Fe^{3+}$ and $Zr^{4+}$. In the present invention, an aluminum compound of di-tert-butylsalicylic acid is preferred as the organometallic compound.

The metal compound of an aromatic carboxylic acid derivative may be synthesized by, e.g., dissolving an aromatic carboxylic acid in an aqueous sodium hydroxide solution, adding dropwise to the aqueous sodium hydroxide solution an aqueous solution in which a divalent or higher metal atom has been melted, heating and stirring the solution, then adjusting its pH, and cooling the solution to room temperature, followed by filtration and water washing to obtain a metal compound of the aromatic carboxylic acid derivative. However, the method is by no means limited to such a synthesis method.

The organometallic compound (metal compound of an aromatic carboxylic acid derivative) may preferably be used in an amount of from 0.5 to 10 parts by weight, preferably from 1 to 9 parts by weight, and more preferably from 1.5 to 8 parts by weight, based on 100 parts by weight of the binder resin. This is preferable in view of the regulation of viscoelastic properties and triboelectric charging performance of the toner.

If it is less than 0.5 part by weight, it not only does not so well function as a charge control agent, but also may achieve no good pigment dispersion. If on the other hand it is more than 10 parts by weight, the cross-linking may proceed in excess to damage fixing performance required as the toner.

In the magenta toner of the present invention, a compound other than the above organometallic compound may be used as the charge control agent in order to make its charging performance more stable.

To produce color toner particles used in the present invention, the binder resin, the pigment as a colorant, the wax, and optionally the charge control agent and other additives are thoroughly mixed by means of a mixing machine such as a ball mill, and then the mixture is melt-kneaded by means of a heat kneading machine such as a heat roll, a kneader or an extruder to make the resin and so forth melt one another, in which the pigment is dispersed, followed by cooling for solidification and thereafter pulverization and strict classification. Thus, the color toner particles can be obtained.

In order to improve the state of dispersion of pigment particles in the color toner particles, it is preferable to put into a kneader or a mixer a first binder resin and a pasty pigment containing 5 to 50% by weight of pigment particles insoluble in the dispersion medium, introducing them into a kneader or a mixer, heat them while mixing them under application of no pressure to cause the first binder resin to melt to move the pasty resin (i.e., pigment in liquid phase) to the molten-resin phase of the first binder resin kept heated, thereafter melt-knead the first binder resin and the pigment particles, followed by removal of the liquid component by evaporation and then drying to obtain a first kneaded product containing the first binder resin and the pigment particles, and then add to the first kneaded product a second binder resin and also optionally additives such as a charge control agent to prepare a mixture, melt-knead the mixture with heating to obtain a second kneaded product, and cool the second kneaded product, followed by pulverization and classification to produce a toner. Here, the first binder resin and the second binder resin may be resins of the same type or may be different resins.

The above pasty pigment may preferably be in a condition in which in the step of producing pigment particles the pigment particles are present without having passed through any drying step at all. In other words, it is a condition in which the pigment particles are present in substantially the state of primary particles in an amount of from 5 to 50% by weight based on the total weight of the pasty pigment. The remaining 50 to 95% by weight in the pasty pigment is held by the greater part of a volatile liquid together with some quantities of a dispersant and an auxiliary agent. There are no particular limitations on the volatile liquid as long as it is a liquid which evaporates upon usual heating. A liquid that may preferably be used also in view of ecology is water.

The kneading machine may include heat kneaders, single-screw extruders, twin-screw extruders, and kneaders, and may particularly preferably include heat kneaders.

The magenta toner of the present invention may preferably have a weight-average particle diameter of from 4 to 10 $\mu$m and a number-average particle diameter of from 3.5 to 9.5 $\mu$m.

If the toner has a weight-average particle diameter larger than 10 $\mu$m, it means that the fine particles contributory to the achievement of high image quality are in a small quantity. This on the one hand brings about an advantage that a high image density can be attained with ease and the toner can have a superior fluidity, but on the other hand the toner may be hard to adhere to the fine electrostatically charged image (electrostatic latent image) on the photosensitive drum, resulting in a low reproducibility at highlight ares and also resulting in a low resolution in some cases. Also, the toner may be laid on the electrostatically charged image in excess to tend to cause an increase in toner consumption.

If on the other hand the toner has a weight-average particle diameter smaller than 4 μm, the toner may have a high charge quantity per unit weight to cause a decrease in image density especially in a low-temperature low-humidity. If so, the toner may be unsuitable especially for the use to form images having a high image area percentage, such as graphic images.

In addition, if the toner has a weight-average particle diameter smaller than 4 μm, its contact charging with charge-providing members such as a carrier may be performed with difficulty, so that any toner not well chargeable may become large in proportion to cause fog conspicuously which is due to toner scatter on non-image areas. To cope with this problem, it may be considered to make carrier's particle diameter smaller in order to gain the specific surface area of the carrier. However, the toner having such a weight-average particle diameter smaller than 4 μm tends to also cause self agglomeration, and it may be difficult for the toner to be uniformly blended with the carrier in a short time, tending to cause fog during running performed supplying the toner continuously.

The magenta toner of the present invention may also preferably contain toner particles of 4 μm or smaller in weight-average particle diameter in an amount of from 5 to 50% by number, and more preferably from 5 to 25% by number, of the number of all particles. If it contains the toner particles of 4 μm or smaller in weight-average particle diameter in an amount smaller than 5% by number, it means that the fine toner particles serving as a component essential for high image quality are in a small quantity. Hence, especially as the toner is continuously consumed by continuous copying or printing, any effective toner particle component may decrease to ill balance the toner's particle size distribution prescribed in the present invention, tending to cause a gradual lowering of image quality.

If on the other hand it contains the toner particles of 4 μm or smaller in weight-average particle diameter in an amount larger than 50% by number, toner particles tend to agglomerate mutually to come to often behave as toner masses larger in diameter than the original particle diameter. As the result, coarse images tend to be formed, resulting in a low resolution, or the electrostatically charged image may have a great difference in density between its edges and interiors, tending to form images with a little blank area.

In view of an improvement in image quality, the magenta toner of the present invention may more preferably contain toner particles of 12.70 μm or larger in weight-average particle diameter in an amount not more than 7% by volume.

In view of an improvement in image quality and in view of storage stability in a high-temperature environment, the magenta toner of the present invention may still more preferably have a fluidity improver added externally. The fluidity improver may preferably be an inorganic fine power such as fine silica powder, fine titanium oxide powder or fine aluminum oxide powder. Such an inorganic fine power may preferably be made hydrophobic with a hydrophobic-treating agent.

The hydrophobic-treating agent may include a coupling agent such as a silane coupling agent, a titanate coupling agent, an aluminum coupling agent and a zircoaluminate coupling agent, a silicone oil or a mixture of these.

Stated specifically, the silane coupling agent may preferably be a compound represented by the following general formula:

$$R_mSiY_n$$

wherein R represents an alkoxyl group; m represents an integer of 1 to 3; Y represents an alkyl group, a vinyl group, a phenyl group, a methacrylic group, an amino group, an epoxy group, a mercapto group or a derivative of any of these; and n represents an integer of 1 to 3.

Such a compound may include, e.g., vinyltrimethoxysilane, vinyltriethoxysilane, γ-methacryloxypropyltrimethoxysilane, methyltrimethoxysilane, methyltriethoxysilane, isobutyltrimethoxysilane, dimethyldimethoxysilane, dimethyldiethoxysilane, trimethylmethoxysilane, hyroxypropyltrimethoxysilane, phenyltrimethoxysilane, n-hexadecyltrimethoxysilane and n-octadecyltrimethoxysilane.

In the treatment, the hydrophobic-treating agent may be used in an amount of from 1 to 60 parts by weight, and preferably from 3 to 50 parts by weight, based on 100 parts by weight of the inorganic fine power.

What is particularly preferred coupling agent in the present invention is an alkylalkoxysilane coupling agent represented by the general formula:

$$C_nH_{2n+1}—Si—(OC_mH_{2m+1})_3$$

wherein n represents an integer of 4 to 12, and m represents an integer of 1 to 3.

In the alkylalkoxysilane coupling agent, if n is smaller than 4, though hydrophobic treatment may be made with ease, a low hydrophobicity may result undesirably. If on the other hand n is larger than 12, though hydrophobicity can be sufficient, fine powder particles may greatly coalesce one another to tend to have a low fluidity-providing ability. If m is larger than 3, the alkylalkoxysilane coupling agent may have a low reactivity to make it hard for the inorganic fine powder to be made well hydrophobic. Accordingly, in the alkylalkoxysilane coupling agent, n may preferably be from 4 to 8, and m may preferably be 1 or 2.

In the treatment with the alkylalkoxysilane coupling agent, the agent may be used in an amount of from 1 to 60 parts by weight, and preferably from 3 to 50 parts by weight, based on 100 parts by weight of the inorganic fine power.

The hydrophobic treatment may be made using one kind of hydrophobic-treating agent alone, or using two or more kinds of agents. For example, the hydrophobic treatment may be made using one kind of coupling agent alone or using two kinds of coupling agents simultaneously, or the hydrophobic treatment may be made first using one coupling agent and thereafter further using another coupling agent.

The fluidity improver described above may preferably be added in an amount of from 0.01 to 5 parts by weight, and preferably from 0.05 to 3 parts by weight, based on 100 parts by weight of the toner particles.

The magenta toner of the present invention is applicable in both one-component developers and two-component developers without any particular limitations thereon. As a carrier used in combination in the case when the magenta toner of the present invention is used in two-component developers, usable are magnetic particles of metals such as iron, nickel, copper, zinc, cobalt, manganese, chromium and rare earth elements, which may be surface-oxidized or unoxidized, alloys or oxides of any of these, and ferrite.

In particular, an Mn—Mg—Fe three-element magnetic ferrite particles formed of manganese, magnesium and iron components as chief components are preferred as carrier particles. Such magnetic carrier particles may preferably be those having been coated with a resin. As the resin, silicone resins are preferred. In particular, a nitrogen-containing silicone resin or a modified silicone resin formed by the reaction of a nitrogen-containing silane coupling agent with a silicone resin is preferred in view of the providing of negative triboelectric charges to the magenta toner of the present invention, the environmental stability of the toner and the prevention of carrier particle surfaces from contamination.

Such a magnetic carrier may preferably have an average particle diameter of from 15 to 60 $\mu$m, and more preferably form 25 to 50 $\mu$m, in relation to the weight-average particle diameter of the toner.

As a method for preparing the magnetic carrier so as to have the above average particle diameter and specific particle size distribution, for example a sieve may be used to make classification. In order to make the classification especially in a good precision, carrier particles may preferably be sieved several times repeatedly, using a sieve having a suitable mesh size. It is also an effective means to use a sieve whose mesh opening shape has been controlled by plating or the like.

When the two-component developer is prepared, good results are obtainable where the toner and the carrier are blended in such a proportion that the toner in the developer is in a concentration of from 2 to 15% by weight, and preferably from 4 to 13% by weight. If the toner is in a concentration lower than 2% by weight, a low image density tends to result. If it is in a concentration higher than 15% by weight, fog and in-machine toner scatter tend to occur.

A preferred specific example of an image-forming apparatus in which the magenta toner of the present invention is usable is described below with reference to FIG. 1.

The image-forming apparatus shown in FIG. 1 has a digital color image printer section (hereinafter simply "printer section") I at a lower part and a digital color image reader section (hereinafter simply "reader section") II at the top. For example, images are formed on a recording medium P by the printer section I in accordance with images read on an original D at the reader section II.

The construction of the printer section I and then the construction of the reader section II are described below.

The printer section I has a photosensitive drum 1 as an electrostatic-image-bearing member driven rotatingly in the direction of an arrow $R_1$. Around the photosensitive drum 1, a primary charging assembly (charging means) 2, an exposure means 3, developing unit (developing means) 4, a transfer unit 5, a cleaning assembly 6, a pre-exposure lamp 7 and so forth are provided in order over the direction of its rotation. Beneath the transfer unit 5 (i.e., at the lower half of the printer section I), a recording medium P feed-and-transport section 8 is disposed. Above the transfer unit 5, a separation means 9 is further provided. On the downstream side of the separation means 9 (downstream side in respect of the recording medium P transport direction), a heat-and-pressure fixing assembly 10 and a paper output unit 11 are also provided.

The photosensitive drum 1 has a drum-shaped substrate 1*a* made of aluminum and an OPC (organic photoconductor) photosensitive member 1*b* which covers the substrate surface, and is so constructed as to be rotatingly driven at a stated process speed (peripheral speed) in the direction of the arrow $R_1$.

The primary charging assembly 2 is a corona charging assembly having a shield 2*a* which stands open at the part facing the photosensitive drum 1, a discharge wire 2*b* which is provided inside the shield 2*a* in parallel to the generatrix of the photosensitive drum 1, and a grid 2*c* which is provided at the opening of the shield 2*a* to control charge potential. To the primary charging assembly 2, charging bias is applied from a power source (not shown) so that the surface of the photosensitive drum 1 can thereby uniformly electrostatically be charged to a stated polarity and a stated potential.

The exposure means 3 has a laser output source (not shown) from which laser light is emitted in accordance with image signals sent from the reader section II (detailed later), a polygon mirror 3*a* for reflecting the laser light, a lens 3*b*, and a mirror 3*c*. The exposure means 3 is so constructed that it exposes the photosensitive drum 1 to light upon irradiation of the photosensitive drum 1 surface by this laser light to remove electric charges at exposed areas to form electrostatic latent images. In the present example, the electrostatic latent images formed on the photosensitive drum 1 surface are color-separated into four colors of yellow, cyan, magenta and black in accordance with the images of the original so that electrostatic latent images corresponding to the respective colors are sequentially formed.

The developing unit 4 has developing assemblies 4Y, 4C, 4M and 4Bk holding therein different-color toners (developers) consisting of a yellow toner, a cyan toner, a magenta toner and a black toner, respectively; the assemblies being provided over the direction of the rotation of the photosensitive drum 1 (the direction of the arrow $R_1$) in order from the upstream side. The developing assemblies 4Y, 4C, 4M and 4Bk each have a developing sleeve 4*a* which can hold thereon the developer having a toner for developing any electrostatic latent image formed on the photosensitive drum 1, and are so constructed that they are disposed at the developing positions where any developing assembly of a stated color, used for the development of any electrostatic latent image alternatively, comes close to the photosensitive drum 1 surface by the operation of each eccentric cam 4*b*, and the toners of the developers held on the developing sleeves 4*a* develop the electrostatic latent images to form toner images (visible images) as developed images. Three developing assemblies other than the developing assembly being on use for the development are kept aside from their developing positions.

The transfer unit 5 has a transfer drum (transfer medium carrying member) 5*a* for holding the recording medium (transfer medium) P on its surface, a transfer charging assembly (transfer charging means) 5*b* for transferring to the recording medium P the toner images formed on the photosensitive drum 1, an attraction charging assembly 5*c* for attracting the recording medium P to the transfer drum 5*a* surface, an attraction roller 5*d* set opposingly thereto, an inside charging assembly 5*e* and an outside charging assembly 5*f*. Over a peripheral open area of the transfer drum 5*a*, axially so supported as to be rotatingly driven in the direction of an arrow R5, a recording medium carrying sheet 5*g* comprised of a dielectric is integrally stretched in a cylindrical form. The recording medium carrying sheet 5*g* makes use of a dielectric sheet such as polycarbonate film. The transfer unit 5 is so constructed as to attract the recording medium P to the surface of the transfer drum 5*a* to hold the former on the latter.

The cleaning assembly 6 has a cleaning blade 6*a* for scraping off any residual toner having remaining on the photosensitive drum 1 surface without being transferred to the recording medium P, and a cleaning container 6*b* for collecting therein the toner having been scraped off.

The pre-exposure lamp 7 is provided adjacently to the upstream side of the primary charging assembly 2, and removes unnecessary electric charges left on the photosensitive drum 1 surface having been cleaned by the cleaning assembly 6.

The paper feed-and-transport section 8 has a plurality of paper feed cassettes 8*a* for holding therein recording mediums P in piles, having different size, paper feed rollers 8*b* for feeding the recording mediums P held in the paper feed cassettes 8*a,* a number of transport rollers, a registration roller 8*c,* and so forth. It feeds recording mediums P of prescribed size to the transfer drum 5*a.*

The separation means 9 has a separation charging assembly 9*a* for separating from the transfer drum 5*a* recording mediums P onto which the toner images have been transferred, a separation claw 9*b,* a separation roller 9*c* and so forth.

The heat-and-pressure fixing assembly 10 has a fixing roller 10*a* having a heater in its interior, and a pressure roller 10*b* which is disposed beneath the fixing roller 10*a* to press the recording medium P against the fixing roller 10*a.*

The paper output unit 11 has a transport path switch guide 11*a,* delivery rollers 11*b,* a paper output tray 11*c* and so forth which are disposed on the downstream side of the heat-and-pressure fixing assembly 10. Also, beneath the transport path switch guide 11*a,* a transport vertical path 11*d,* a reverse path 11*e,* a lay-up member 11*f,* an intermediate tray 11*g,* and also a transport rollers 11*h* and 11*i,* reverse rollers 11*j* and so forth are disposed so that images can be formed on both sides of one sheet of the recording medium P.

Around the photosensitive drum 1, a potential sensor S1 for detecting charge potential of the photosensitive drum 1 surface is also disposed between the primary charging assembly 2 and the developing unit 4, and a density sensor S2 for detecting the density of toner images formed on the photosensitive drum 1 is still also disposed between the developing unit 4 and the transfer drum 5*a.*

The reader section II is described subsequently. The reader section II disposed above the printer section I has an original glass plate 12*a* for placing an original D thereon, an exposure lamp 12*b* for exposure-scanning the image surface of the original D while moving, a plurality of mirrors 12*c* for further reflecting the light reflected from the original D, a lens 12*d* for converging the reflected light, and a full-color sensor 12*e* for forming color separation image signals in accordance with the light coming from the lens 12*d.* The color separation image signals are processed by a video processing unit (not shown) through an amplifying circuit (not shown) and then forwarded to the printer section I described above.

How the image-forming apparatus constructed as described above is operated is described below. In the following description, it is intended to form a full-color image using four colors in the order of yellow, cyan, magenta and black.

The image of the original D placed on the original glass plate 12*a* of the reader section II is irradiated by light emitted from the exposure lamp 12*b,* and then color-separated, where an yellow image is first read by the full-color sensor 12*e* and processed there as prescribed, and the image signals formed are sent to the printer section I.

In the printer section I, the photosensitive drum 1 is rotatingly driven in the direction of the arrow $R_1$, and its surface is uniformly electrostatically charged by means of the primary charging assembly 2. In accordance with the image signals sent from the above reader section II, the laser light is emitted from the laser output source of the exposure means 3, so that the photosensitive drum 1 surface having electrostatically been charged is exposed to light by an optical image E via the polygon mirror 3*a.* At the part thus exposed on the photosensitive drum 1 surface, electric charges are removed, whereupon an electrostatic latent image (electrostatically charged image) corresponding to yellow is formed. In the developing unit 4, the yellow developing assembly 4Y is located at the preset developing position, and other developing assemblies 4C, 4M and 4Bk are kept aside from their developing positions. To the electrostatically charged image on the photosensitive drum 1, the yellow toner is made to adhere by the developing assembly 4Y to make the latent image visible to form a yellow toner image. This yellow toner image on the photosensitive drum 1 surface is transferred to a recording medium P carried on the transfer drum 5*a.* The recording medium P is a recording medium P having a size suited for the original image and having been fed at a prescribed timing from the corresponding paper feed cassette 8*a* to the transfer drum 5*a* via the paper feed roller 8*b,* the transport rollers and the registration roller 8*c.* The recording mediums P thus fed is so attracted to the transfer drum 5*a* as to wind around its surface, and is rotated in the direction of the arrow R5, thus the yellow toner image on the photosensitive drum 1 is transferred by means of the transfer charging assembly 5*b.*

Meanwhile, the photosensitive drum 1 from which the yellow toner has been transferred is cleaned by the cleaning assembly 6 to remove the toner remaining on the surface, which is further treated by the pre-exposure lamp 7 to remove unnecessary electric charges, and is then used for the next image formation starting from the primary charging.

The above process starting from the reading of original image at the reader section II, coming through the transfer of the toner image to the recording medium P held on the transfer drum 5*a* and also ending with the cleaning of the photosensitive drum 1 and charge elimination therefrom is repeated also on other colors, i.e., cyan, magenta and black. Thus, to the recording medium P on the transfer drum 5*a,* toner images of four colors of the yellow toner, cyan toner, magenta toner and black toner are superimposingly transferred.

The recording medium P to which the four-color toner images have been transferred is separated from the transfer drum 5*a* by means of the separation charging assembly 9*a,* the separation claw 9*b* and so forth, and then transported to the fixing assembly 10 in the state it carries unfixed toner images on its surface. The recording medium P is heated and pressed by the fixing roller 10*a* and pressure roller 10*b* of the heat-and-pressure fixing assembly 10, so that the color toner images are melted and fixed and a full-color image is formed on one side of the recording medium P. After the fixing, the recording medium P is delivered out onto the paper output tray 11*c* by the aid of the delivery rollers 11*b.*

The heat-and-pressure fixing assembly 10 is described below with reference to FIG. 2.

Figure 2:
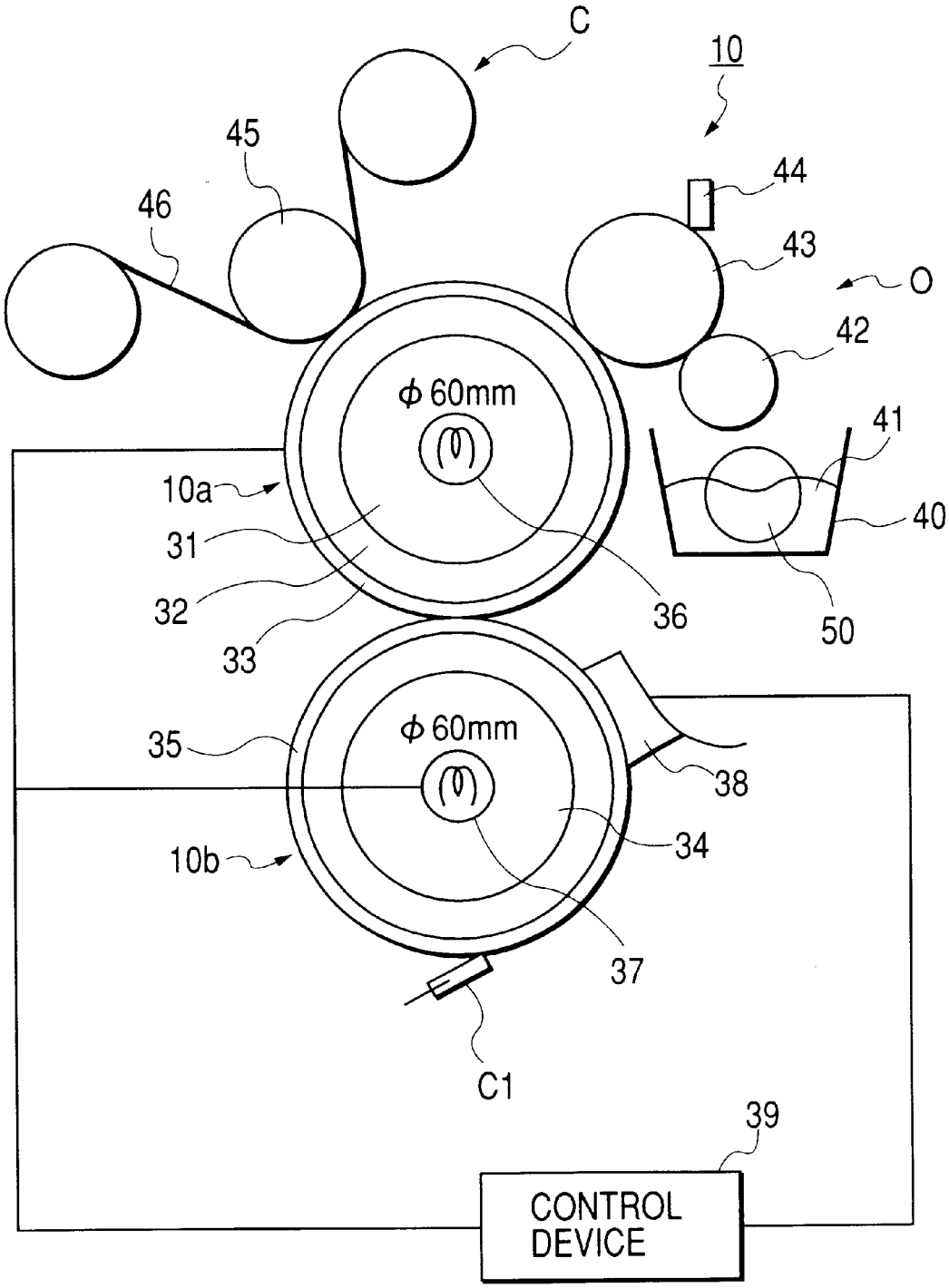
FIG. 2 illustrates a specific example of a fixing assembly in an image-forming apparatus in which the magenta toner of the present invention is used.

In FIG. 2, a fixing roller 10*a* comprises, e.g., a mandrel 31 made of aluminum and provided thereon a 1 mm thick HTV (high-temperature vulcanizing) silicone rubber layer 32 and, on the outer surface thereof, a specific addition type silicone rubber layer 33, and is formed in 60 mm diameter.

Meanwhile, a pressure roller 10*b* comprises, e.g., a mandrel 34 made of aluminum and provided thereon a 1 mm thick HTV silicone rubber layer and also the same specific addition type silicone rubber layer 35 having a 1 mm thickness, and is formed in 60 mm diameter.

The fixing roller 10*a* is provided with a heat-generating means halogen heater 36 in the mandrel 31 and the pressure roller 10*b* is similarly provided with a halogen heater 37 in the mandrel 34 so that the heat can be applied on the both sides of the recording medium P. The temperature of the pressure roller 10*b* is detected by a thermistor 38 brought into contact with the pressure roller 10*b*. In accordance with the temperature thus detected, the halogen heaters 36 and 37 are controlled by a control unit 39, and the temperature of the fixing roller 10*a* and that of the pressure roller 10*b* are so controlled as to be both kept constant at 170° C. The fixing roller 10*a* and the pressure roller 10*b* are pressed against each other at a total pressure of about 80 kg by means of a pressing mechanism (not shown).

In FIG. 2, letter symbol O denotes an oil application unit; C, a cleaning unit; and C1, a cleaning blade for removing any oil having contaminated the pressure roller 10*b*. The oil application unit O applies dimethylsilicone oil 41 held in an oil pan 40, to the fixing roller 10*a* via oil draw-up rollers 50 and 42 and an oil coating roller 43 while controlling oil coating weight by means of an oil coating weight regulation blade 44. The cleaning unit C cleans the surface of the fixing roller 10*a* with a web 46 brought into contact with the fixing roller 10*a* surface by a press touch roller 45.

In the fixing unit 10 described above, the recording medium P holding the unfixed toner images on its surface is transported to and held at a fixing nip between the fixing roller 10*a* and pressure roller 10*b*, where the heat and pressure are applied from the both sides to fix the toner images. Here, any toner having adhered to the fixing roller 10*a* and pressure roller 10*b* is removed by means of the cleaning unit C and the cleaning blade C1, respectively.

In the foregoing, the formation of a full-color image on only one side of the recording medium is described. A method and system for forming the full-color image on the both sides of the recording medium are described below with reference to FIG. 1.

When the full-color image is formed on the both sides of the recording medium P, the recording medium P having been delivered out of the heat-and-pressure fixing assembly 10 is, after the transport path switch guide 11*a*, is immediately driven, once guided to the reverse path 11*e* via the transport path 11*d*. Then, the reverse rollers 11*j* are rotated in reverse so that the recording medium P is withdrawn in the direction opposite to the direction in which it has been sent into the rollers, with its leading end first which had been the rear end when sent into the rollers, and is received in the intermediate tray 11*g*. Thereafter, the recording medium P in the intermediate tray 11*g*, having the full-color image on its one side, is sent to the transfer drum 5*a*, where color toner images of the yellow toner, cyan toner and magenta toner are anew transferred, and a black toner image is further transferred, to the other side of the recording medium P by the image formation process described above. Since the full-color image on one side of the recording medium P comes into contact with the transfer drum 5*a*, the silicone oil having adhered to the full-color image surface at the time of fixing may adhere to the transfer drum 5*a* to tend to inhibit the step of transfer. However, the color toners used in the present invention are capable of well absorbing silicone oil, and hence the silicone oil may adhere to the transfer drum 5*a* in a very small quantity compared with conventional ones.

The recording medium P having unfixed full-color toner images on the other side surface thereof is separated from the transfer drum 5*a* and sent to the heat-and-pressure fixing assembly 10, and the unfixed full-color toner images are heat-and-pressure fixed to the other side surface of the recording medium P, thus full-color images are formed on the both sides of the recording medium P. Here, the color toners used in the present invention contain a specific hydrophobic fine powder of, e.g., alumina having externally been added to color toner particles, and have specific particle size distribution and specific storage elastic modulus. Hence, the double-side image formation can well be performed, the recording medium P can be kept from being wound around the fixing roller 10*a* and pressure roller 10*b*, and also the phenomenon of offset can well be prevented from occurring.

The use of such color toners may very less cause contamination with, e.g., silicone oil than ever in respect of the recording medium carrying sheet 5*g* of the transfer drum 5*a*. If necessary, however, it may be cleaned with a fur brush 13*a* and a back-up brush 13*b* and with an oil-removing roller 14*a* and a back-up brush 14*b*. Such cleaning may optionally be performed before the image formation or after the image formation, or may be performed at any time when paper jam occurs.

Various physical properties of toner are measured in the manner described below.

Measurement of storage elastic modulus of toner:

Toner is pressure-molded into a disk-like sample having a thickness of from about 2 to 3 mm. Next, the sample is set between parallel plates, and then heated gradually within the temperature region of from 50 to 200° C. to make measurement of temperature dispersion. Heating rate is set at 2° C./min, angular frequency (ω)) is fixed at 6.28 rad/sec., and measurement of distortion rate is set automatic. Temperature is plotted as abscissa and storage elastic modulus (G') as ordinate, and values at every temperature are read. In the measurement, RDA-II (trade name; manufactured by Rheometrics Co.) is used. In the present invention, there are no particular limitations on the measuring instrument.

Measurement of endothermic peak of toner:

Measured according to ASTM D3418-82, using a differential thermal analyzer (DSC measuring device) DSC-7 (manufactured by Perkin Elmer Co.).

A sample for measurement is precisely weighed in an amount of from 2 to 10 mg, preferably 5 mg. This sample is put in a pan made of aluminum and an empty aluminum pan is set as reference. Measurement is made in a normal-temperature normal-humidity environment at a heating rate of 10° C./min within the measuring temperature range of from 30 to 200° C. In the course of this heating, main peak endothermic peaks of the DSC curve in the temperature range of from 30 to 200° C. are obtained.

Measurement of molecular weight by GPC:

Molecular weights of constituents in a chromatogram obtained by gel permeation chromatography (GPC) are measured under the following conditions.

Columns are stabilized in a heat chamber of 40° C. To the columns kept at this temperature, tetrahydrofuran (THF) as a solvent is flowed at a flow rate of 1 ml per minute, and about 50 to 200 μl of a THF sample solution of resin which has been regulated to have a sample concentration of from 0.05 to 0.6% by weight is injected thereinto to make measurement. In measuring the molecular weight of the sample, the molecular weight distribution ascribed to the sample is calculated from the relationship between the logarithmic value and count number (retention time) of a calibration curve prepared using several kinds of monodisperse polystyrene standard samples. As the standard polystyrene samples used for the preparation of the calibration curve, it is suitable to use samples with molecular weights of 600, 2,100, 4,000, 17,500, 51,000, 110,000, 390,000, 860,000, 2,000,000 and 4,480,000, which are available from Toso Co., Ltd. or Pressure Chemical Co., and to use at least about 10 standard polystyrene samples. An RI (refractive index) detector is used as a detector.

As columns, in order to make precise measurement in the region of molecular weight from 1,000 to 2,000,000, it is desirable to use a plurality of commercially available polystyrene gel columns in combination. For example, they may preferably comprise a combination of Shodex GPC KF-801, KF-802, KF-803, KF-804, KF-805, KF-806 and KF-807, available from Showa Denko K. K., and a combination of $\mu$-Styragel 500, $10^3$, $10^4$, and $10^5$, available from Waters Co.

Measurement of particle size distribution of toner:

In the present invention, the average particle diameter and particle size distribution of the toner are measured with a Coulter counter Model TA-II (manufactured by Coulter Electronics, Inc.). Coulter Multisizer (manufactured by Coulter Electronics, Inc.) may also be used. As an electrolytic solution, an aqueous 1% NaCl solution is prepared using first-grade sodium chloride. For example, ISOTON R-II (trade name; manufactured by Coulter Scientific Japan Co.) may be used. Measurement is made by adding as a dispersant 0.1 to 5 ml of a surface active agent, preferably an alkylbenzene sulfonate, to 100 to 150 ml of the above aqueous electrolytic solution, and further adding 2 to 20 mg of a sample to be measured. The electrolytic solution in which the sample has been suspended is subjected to dispersion for about 1 minute to about 3 minutes in an ultrasonic dispersion machine. The volum-67 e distribution and number distribution of the toner are calculated by measuring the volume and number of toner particles of 2.00 $\mu$m or larger diameter by means of the above measuring instrument, using an aperture of 100 $\mu$m as its aperture. Then the weight-based, weight average particle diameter (D4: the middle value of each channel is used as the representative value for each channel) according to the present invention, determined from the volume distribution of toner particles, are determined.

As channels, 13 channels are used, which are of 2.00 to 2.52 $\mu$m, 2.52 to 3.17 $\mu$m, 3.17 to 4.00 $\mu$m, 4.00 to 5.04 $\mu$m, 5.04 to 6.35 $\mu$m, 6.35 to 8.00 $\mu$m, 8.00 to 10.08 $\mu$m, 10.08 to 12.70 $\mu$m, 12.70 to 16.00 $\mu$m, 16.00 to 20.20 $\mu$m, 20.20 to 25.40 $\mu$m, 25.40 to 32.00 $\mu$m, and 32.00 to 40.30 $\mu$m.

EXAMPLES

The present invention is described below by giving specific working examples. The present invention is by no means limited to these examples.

Hybrid Resin Production Example 1

As materials for the vinyl copolymer, 1.9 mols of styrene, 0.21 mol of 1,2-ethylhexyl acrylate, 0.15 mol of fumaric acid, 0.03 mol of a dimer of $\alpha$-methylstyrene and 0.05 mol of dicumyl peroxide were put into a dropping funnel. Also, 7.0 mols of polyoxypropylene(2.2)-2,2-bis(4-hydroxyphenyl)propane, 3.0 mols of polyoxyethylene(2.2)-2,2-bis(4-hydroxyphenyl)propane, 3.0 mols of terephthalic acid, 2.0 mols of trimellitic anhydride, 5.0 mols of fumaric acid and 0.2 g of dibutyltin oxide were put into a 4-liter four-necked flask made of glass, and a thermometer, a stirring rod, a condenser and a nitrogen feed tube were attached thereto. This was placed in a mantle heater. Next, the inside of the flask was displaced with nitrogen gas, followed by gradual heating with stirring. With stirring at a temperature of 145° C., the monomers, cross-linking agent and polymerization initiator for the vinyl copolymer were dropwise added thereto from the dropping funnel over a period of 4 hours. Subsequently, the mixture was heated to 200° C. to carry out reaction for 4 hours to obtain a hybrid resin, Resin (1). Its molecular weight was measured by GPC to obtain the results shown in Table 1.

Hybrid Resin Production Example 2

The reaction was carried out in the same manner as in Hybrid Resin Production Example 1 except that 3.8 mols of styrene, 0.07 mol of a dimer of $\alpha$-methylstyrene and 0.1 mol of dicumyl peroxide were used as the materials for vinyl copolymer, to obtain a hybrid resin, Resin (2). Its molecular weight was measured by GPC to obtain the results shown in Table 1.

Hybrid Resin Production Example 3

The reaction was carried out in the same manner as in Hybrid Resin Production Example 1 except that in place of 5.0 mols of the fumaric acid 4.0 mols of maleic acid and 3.5 mols of itaconic acid were used and in place of 0.05 mol of the dicumyl peroxide 0.1 mol of isobutyl peroxide was used, to obtain a hybrid resin, Resin (3). Its molecular weight was measured by GPC to obtain the results shown in Table 1.

Hybrid Resin Production Example 4

The reaction was carried out in the same manner as in Hybrid Resin Production Example 1 except that in place of 3.0 mols of the terephthalic acid and 2.0 mols of the trimellitic anhydride 5.2 mols of trimellitic anhydride was used, to obtain a hybrid resin, Resin (4). Its molecular weight was measured by GPC to obtain the results shown in Table 1.

Polyester Resin Production Example 1

3.6 mols of polyoxypropylene(2.2)-2,2-bis(4-hydroxyphenyl)propane, 1.6 mols of polyoxyethylene(2.2)-2,2-bis(4-hydroxyphenyl)propane, 1.7 mols of terephthalic acid, 1.1 mols of trimellitic anhydride, 2.4 mols of fumaric acid and 0.1 g of dibutyltin oxide were put into a 4-liter four-necked flask made of glass, and a thermometer, a stirring rod, a condenser and a nitrogen feed tube were attached thereto. This was placed in a mantle heater. In an atmosphere of nitrogen, reaction was carried out at 215° C. for 5 hours to obtain a polyester resin, Resin (5). Its molecular weight was measured by GPC to obtain the results shown in Table 1.

Polyester Resin Production Example 2

With monomer constitution of 1.6 mols of polyoxypropylene(2.2)-2,2-bis(4-hydroxyphenyl)propane, 3.3 mols of polyoxyethylene(2.2)-2,2-bis(4-hydroxyphenyl)propane, 1.6 mols of terephthalic acid, 0.3 mol of trimellitic anhydride and 3.2 mols of fumaric acid, reaction was carried out like that in the above, to obtain a polyester resin, Resin (6). Its molecular weight was measured by GPC to obtain the results shown in Table 1.

Vinyl Resin Production Example 1

2.2 mols of styrene, 0.23 mol of 1,2-ethylhexyl acrylate, 0.08 mol of dicumyl peroxide and 3.2 g of dibutyltin oxide were put into a 3-liter four-necked flask having a thermometer, a stirring rod made of stainless steel, a falling-film condenser and a nitrogen feed tube. In a mantle heater, in an atmosphere of nitrogen, reaction was carried out at a temperature of 225° C. with stirring to obtain a vinyl resin, Resin (7). Its molecular weight was measured by GPC to obtain the results shown in Table 1.

TABLE 1

| Molecular Weight Measurement Results (GPC) | | | | |
|---|---|---|---|---|
| | Mw ($\times 10^3$) | Mn ($\times 10^3$) | Main-peak molecular weight ($\times 10^3$) | Mw/Mn |
| Hybrid resin: | | | | |
| Resin (1) | 83.0 | 3.1 | 15.4 | 26.77 |
| Resin (2) | 72.1 | 3.2 | 15.1 | 22.53 |
| Resin (3) | 108.1 | 4.2 | 30.3 | 25.74 |
| Resin (4) | 294.9 | 4.5 | 89.4 | 65.53 |
| Polyester resin: | | | | |
| Resin (5) | 25.7 | 3.2 | 6.4 | 8.03 |
| Resin (6) | 4.3 | 2.2 | 3.1 | 1.95 |
| Vinyl resin: | | | | |
| Resin (7) | 19.0 | 2.7 | 9.1 | 7.04 |

Waxes used in the following Examples and Comparative Examples are shown in Table 2 below.

TABLE 2

| | Melting point | Type of wax |
|---|---|---|
| Wax (A) | 74.3° C. | purified normal paraffin |
| Wax (B) | 72.8° C. | ester wax |
| Wax (C) | 58.9° C. | paraffin |
| Wax (D) | 95.2° C. | polyethylene |
| Wax (E) | 111.4° C. | alcohol-modified PE |

Example 1

Magenta toner 1 was prepared in the following way. First kneading step:

Resin-(1) Hybrid Resin 70 Parts (By Weight)

First pasty pigment with 30% by weight of solid content, obtained by removing water to a certain extent from a pigment slurry containing the compound (1-1) and without having passed through any drying step at all (remaining 70% by weight: water) 30 parts Second pasty pigment with 30% by weight of solid content, obtained by removing water to a certain extent from a pigment slurry containing the compound (3-1) and without having passed through any drying step at all (remaining 70% by weight: water) 70 parts The above materials were introduced into a kneader type mixer under the above formulation, and were heated with stirring under application of no pressure. At the time the resultant mixture reached a maximum temperature (which depends necessarily on the boiling point of a solvent in the paste; in this case, about 90 to 100° C.), the pigment in aqueous phase became distributed or moved to the molten resin phase. Having made sure of this, the mixture was further melt-kneaded with heating to cause the pigments in the paste to move sufficiently to the resin phase. Thereafter, the mixer was once stopped, and the hot water was discharged. Then the mixture was further heated to 130° C. and melt-kneaded for about 30 minutes with heating to disperse the resin, and the water was evaporated off to stop the kneading step, followed by cooling to take out the kneaded product to obtain a first kneaded product. This first kneaded product had a water content of about 0.5% by weight.

| Second kneading step: | (by weight) |
|---|---|
| The above first kneaded product (content of pigment particles: 30% by weight) | 20.0 parts |
| Resin-(1) hybrid resin | 86.0 parts |
| Wax (A) | 5.0 parts |
| Aluminum compound of di-tert-butylsalicylic acid (charge control agent) | 4.0 parts |

The above materials were premixed by means of a Henschel mixer, and the mixture obtained was melt-kneaded using a twin-screw kneader, setting its temperature at 100° C. Actual temperature of the kneaded product at the outlet of the kneader was 140° C., and the viscosity of the kneaded product was greatly increased, compared with that of the Resin-(1) hybrid resin. This kneaded product was cooled and thereafter crushed by means of a hammer mill into particles of about 1 to 2 mm in diameter. The crushed product was then finely pulverized by means of a fine grinding mill of an air jet system into particles of about 20 $\mu$m or smaller in diameter. The finely pulverized product thus obtained was further classified, and the classified product was so selected as to have a weight-average particle diameter of 7.2 $\mu$m in its particle size distribution, to obtain magenta toner particles (classified product).

In order to improve fluidity and impart chargeability, 1.0 part by weight of hydrophobic fine aluminum oxide powder (BET specific surface area: 170 $m^2/g$) having been treated with 25 parts by weight of i-$C_4H_9Si(OCH_3)_3$ was added to 100 parts by weight of the above magenta toner particles (resin particles) to obtain magenta toner 1.

The magenta toner 1 was further blended with magnetic ferrite carrier particles (average particle diameter: 45 $\mu$m) surface-coated with silicone resin, which were so blended as to be in a toner concentration of 7% by weight. Thus, a two-component magenta developer 1 was obtained. The results of measurement on the toner are shown in Table 3(A) and 3(B).

Using this magenta developer 1 and using a remodeled machine of a color copying machine CLC-800 (trade name, manufactured by CANON INC.), from a fixing unit of which an oil application mechanism had been detached, a 10,000-sheet running test was made in a high-temperature high-humidity environment (30° C./80% RH), using an original having an image area percentage of 20%, and also a fixing test was made in a normal-temperature and normal-humidity environment (23° C./60% RH). Also, in respect of the evaluation of the fixable temperature range, the fixing unit was so remodeled as to be able to set the fixing temperature manually.

Even after the 10,000-sheet running test, magenta images free of fog and having reproduced the original image faithfully were obtained, exhibiting a superior color reproducibility. Paper transport through the interior of the copying machine and detection of developer concentration were also good, and stable image density was obtained. In repeated copying on 10,000 sheets setting the fixing temperature to 170° C., too, any offset on the fixing roller did not occur at all. Here, the occurrence of offset to the fixing roller was checked by visual observation of the surface of the fixing roller after the repeated copying.

As a method of evaluating color copied images, a method is available in which gloss (glossiness) of image surfaces is measured to judge the quality of color images. More specifically, when images have a higher glossiness, the images are judged to have a color quality with a higher saturation (chroma) as having smooth and glossy image surfaces. When, on the other hand, images have a low glossiness, the images are judged to have coarse image surfaces with a poor saturation as being dull. In Example 1, image density at contrast potential of 300 V was 1.70 (Macbeth reflection density), and the glossiness on that occasion was 21%.

To measure the gloss (glossiness), a Model PG-10 glossiness meter, manufactured by Nippon Denshoku K.K., was used. In the measurement, light projection angle and light reception angle were each adjusted to 75°. After zero-adjustment and the setting of standard using a standard plate, three sheets of white paper were placed on a sample stand, and the above sample images were superposed thereon to make measurement. Numerical values indicated at an indication area were read in units of %.

On the images obtained, the intended color tone was obtained. More specifically, it was a*=72.2, b*=−2.8 and L*=47.3.

The color tone of the toner was quantitatively measured in accordance with the definition of a colorimetric system as standardized in 1976 by The Commission Internationale de l'Eclairage, Paris (CIE). Here, the image density was fixed at 1.70, and a*, b* (a* and b* represent chromaticity which indicates hue and saturation, respectively) and L* (lightness) were measured. A spectral colorimeter Type-938, manufactured by X-Rite Co., was used as a measuring instrument, and a C-light source as a light source for observation. The visual angle was set at 2°.

Color images formed on transparency films were also projected by means of an overhead projector (OHP). OHP images thus projected showed a good transparency.

With regard to the transparency of the OHP images in the present Example, color images formed on the transparency film were projected using a commercially available overhead projector, and their transparency was evaluated according to the following evaluation criteria:

(Evalution Criteria)

A: Having a superior transparency, free of uneven brightness, and also having a superior color reproducibility.

B: Having an uneven brightness slightly, but no problem in practical use.

C: Having an uneven brightness and having a poor color reproducibility.

Light-fastness of the solid images obtained (image density: 1.70) was examined substantially according to JIS K7102. As a result, images after 400 hour exposure to light showed substantially the same image density (1.66) as those at the initial stage, and also almost no changes in hue were seen (ΔE=2.8). A carbon arc lamp was used as a light source. As criteria for the evaluation of light-fastness, ΔE values were determined from images before and after the exposure to make evaluation quantitatively.

(Light-fastness Ranks)

A: Change is little seen in 400-hour testing.

B: Change is little seen in 200-hour testing.

C: Fading occurs in 100-hour testing.

As a result of examination of the storage stability of the magenta toner 1, good data were shown. More specifically, with regard to anti-blocking properties of sample toners, it was evaluated after the samples were left for 2 weeks in a 50° C. oven. To make evaluation, the level of agglomeration was visually judged.

(Anti-blocking Properties Evalution Criteria)

A: No agglomerate is seen at all, showing very good fluidity.

B: Some agglomerates are seen, but become loose easily.

C: Agglomerates do not become loose well by means of a developer agitator.

Results of evaluation are shown in Table 3(A) and 3(B).

Cyan toner 1 and yellow toner 1 were prepared in substantially the same manner as the magenta toner 1 except that in place of the pigment used therein a copper phthalocyanine type cyan pigment (Pigment Blue 15:3) and a diarylide type yellow pigment (Pigment Yellow 17), respectively, were used and corresponding developers were prepared in substantially the same way. Using these developers, images were reproduced. Reproducibility of red and blue secondary colors was examined. As a result, images having both high saturation and high lightness and good hues were obtained.

Examples 2 to 5

Magenta toners 2 to 5 were prepared in the same manner as in Example 1 except that in place of the Resin-(1) hybrid resin the Resin-(2) hybrid resin, the Resin-(3) hybrid resin, the Resin-(5) polyester resin and the Resin-(7) vinyl resin were used, respectively. Magenta developers 2 to 5 were obtained in the same way. The results of measurement on the toners and the results of evaluation made in the same way are shown in Table 3(A) and 3(B).

Example 6

Magenta toner 6 was prepared in the same manner as in Example 1 except that the toner was so prepared that the mixing proportion of the compound (1-1) and the compound (3-1) came finally to be 1:9. Magenta developer 6 was obtained in the same way. The color tone was evaluated in the same way. As a result, the color tone at the image density of 1.70 shifted to a tinge of blue compared with that of Example 1, but was well on a level tolerable in practical use, and red was also in a good reproducibility. More specifically, the color tone of images was a*=71.2, b*=−12.8 and L*=45.3. Other results of measurement and evaluation are shown in Table 3(A) and 3(B).

Example 7

Magenta toner 7 was prepared in the same manner as in Example 1 except that the toner was so prepared that the mixing proportion of the compound (1-1) and the compound (3-1) came finally to be 4:6. Magenta developer 7 was obtained in the same way. The color tone was evaluated in the same way. As a result, the color tone at the image density of 1.70 shifted to a tinge of red compared with that of Example 1, but was well on a level tolerable in practical use, and reproducibility of blue was also of no problem. More specifically, the color tone of images was a*=70.8, b*=3.2 and L*=42.7. Other results of measurement and evaluation are shown in Table 3(A) and 3(B).

Example 8

Magenta toner 8 was prepared in the same manner as in Example 1 except that the toner was so prepared that the mixing proportion of the compound (1-1) and the compound (3-1) came finally to be 6:4. Magenta developer 8 was obtained in the same way. The color tone was evaluated in the same way. As a result, the color tone at the image density of 1.70 shifted fairly to a tinge of red compared with that of Example 1, but was well on a level tolerable in practical use, and reproducibility of blue was also of no problem. More specifically, the color tone of images was a*=70.8, b*=5.4 and L*=43.1. Other results of measurement and evaluation are shown in Table 3(A) and 3(B).

Example 9

Magenta toner 9 was prepared in the same manner as in Example 1 except that in place of the Wax-(A) purified normal paraffin wax the Wax-(B) ester wax was used. Magenta developer 9 was obtained in the same way. The results of measurement on the toner and the results of evaluation made in the same way are shown in Table 3(A) and 3(B).

Example 10

Magenta toner 10 was prepared in the same manner as in Example 1 except that in place of the Wax-(A) purified normal paraffin wax the Wax-(D) polyethylene wax was used. Magenta developer 10 was obtained in the same way. The results of measurement on the toner and the results of evaluation made in the same way are shown in Table 3(A) and 3(B).

Example 11

Magenta toner 11 was prepared in the same manner as in Example 1 except that the aluminum compound of di-tert-butylsalicylic acid was added in a smaller amount of 2 parts by weight. Magenta developer 11 was obtained in the same way. The results of measurement and evaluation are shown in Table 3(A) and 3(B).

A slightly inferior result was obtained in respect of anti-blocking properties, but not on a level problematic in practical use.

Example 12

Magenta toner 12 was prepared in the same manner as in Example 1 except that 4 parts by weight of a zinc compound of di-tert-butylsalicylic acid was used instead. Magenta developer 12 was obtained in the same way. The results of measurement and evaluation are shown in Table 3(A) and 3(B).

A slightly inferior result was obtained in respect of anti-blocking properties, but not on a level problematic in practical use. Also, in the fixing test, the offsetting temperature on the high-temperature side was lower by about 30° C. than that of the magenta toner 1 of Example 1, but on a level tolerable in practical use.

In the 10,000-sheet running test made in a low-temperature low-humidity environment, the magenta toner 12 showed a tendency of charge-up and showed a tendency of a gradual lowering of image density with progress of the running, but on a level tolerable in practical use.

Examples 13 to 16

Magenta toners 13 to 16 were prepared in the same manner as in Example 1 except that in place of the pigment of compound (1-1) the pigment of compound (1-2), the pigment of compound (1-3), the pigment of compound (1-4), the pigment of compound (1-5) were used, respectively. Magenta developers 13 to 16 were obtained in the same way. The results of measurement on the toners and the results of evaluation made in the same way are shown in Table 3(A) and 3(B).

Example 17

Magenta toner 17 was prepared in the same manner as in Example 1 except that in place of the Resin-(1) hybrid resin the Resin-(2) hybrid resin was used and in place of the Wax-(A) purified normal paraffin wax the Wax-(C) paraffin wax was used. Magenta developer 17 was obtained in the same way. The results of measurement and evaluation are shown in Table 3(A) and 3(B).

An inferior result was obtained in respect of anti-blocking properties, which was barely on a level tolerable in practical use. Also, in the fixing test, the offsetting temperature on the high-temperature side was lower by about 30° C. than that of the magenta toner 1 of Example 1, but on a level tolerable in practical use.

Example 18

Magenta toner 18 was prepared in the same manner as in Example 1 except that in place of the Resin-(1) hybrid resin the Resin-(2) hybrid resin was used and in place of the Wax-(A) purified normal paraffin wax the Wax-(E) alcohol-modified PE wax was used. Magenta developer 18 was obtained in the same way. The results of measurement and evaluation are shown in Table 3(A) and 3(B).

The magenta toner 18 showed a tendency of providing a slightly low OHP transparency because of an influence by the crystallizability of the wax. It also showed a lowering of fixing performance on the low-temperature side, but barely on a level tolerable in practical use.

Example 19

Magenta toner 19 was prepared in the same manner as in Example 17 except that the Wax-(C) paraffin wax was not used. Magenta developer 19 was obtained in the same way. The results of measurement and evaluation are shown in Table 3(A) and 3(B).

The magenta toner 19 showed greatly low high-temperature side anti-offset properties because it did not contain any wax, and also showed a lowering of fixing performance on the low-temperature side, which, however, were barely on a level tolerable in practical use.

Example 20

The same magenta toner particles (classified product) but having a weight-average particle diameter of 4.8 $\mu$m in its particle size distribution were prepared in the same manner as in Example 1. In order to improve fluidity and provide chargeability, 1.2 parts by weight of hydrophobic fine aluminum oxide powder (BET specific surface area: 170 $m^2/g$) having been treated with 25 parts by weight of i-$C_4H_9Si(OCH_3)_3$ was added to 100 parts by weight of the above magenta toner particles (resin particles) to obtain magenta toner 20. Magenta developer 20 was obtained in the same way. The results of measurement and evaluation are shown in Table 3(A) and 3(B).

This toner showed substantially the same fixing performance as the magenta toner of Example 1. In the 10,000-sheet running test made in a low-temperature low-humidity environment, however, the toner showed a tendency of charge-up and showed a little decrease in image density with progress of the running.

Example 21

The same magenta toner particles (classified product) but having a weight-average particle diameter of 9.8 $\mu$m in its particle size distribution were prepared in the same manner as in Example 1. In order to improve fluidity and provide chargeability, 0.8 part by weight of hydrophobic fine aluminum oxide powder (BET specific surface area: 170 $m^2/g$) having been treated with 25 parts by weight of i-$C_4H_9Si(OCH_3)_3$ was added to 100 parts by weight of the above magenta toner particles (resin particles) to obtain magenta toner 21. Magenta developer 21 was obtained in the same way. The results of measurement and evaluation are shown in Table 3(A) and 3(B).

This toner showed substantially the same fixing performance as the magenta toner of Example 1. In the image reproduction in a low-temperature low-humidity environment, however, the toner showed a little lowering of halftone reproducibility, and images which were somewhat coarse as a whole were obtained, but on a level tolerable in practical use.

Example 22

The same magenta toner particles (classified product) but having a weight-average particle diameter of 3.9 $\mu$m in its particle size distribution were prepared in the same manner as in Example 1. In order to improve fluidity and provide chargeability, 1.3 parts by weight of hydrophobic fine aluminum oxide powder (BET specific surface area: 170 $m^2/g$) having been treated with 25 parts by weight of i-$C_4H_9Si(OCH_3)_3$ was added to 100 parts by weight of the above magenta toner particles (resin particles) to obtain magenta toner 22. Magenta developer 22 was obtained in the same way. The results of measurement and evaluation are shown in Table 3(A) and 3(B).

This toner showed a fixing performance narrower by 10° C. on both the low-temperature side and the high-temperature side than the magenta toner 1 of Example 1, but substantially the same results were obtained. In the 10,000-sheet running test made in a low-temperature low-humidity environment, however, the magenta toner 22 showed a tendency of charge-up and showed a decrease in image density with progress of the running, also causing a little fog in the midst of the running.

Example 23

The same magenta toner particles (classified product) but having a weight-average particle diameter of 10.5 $\mu$m in its particle size distribution were prepared in the same manner as in Example 1. In order to improve fluidity and provide chargeability, 0.7 part by weight of hydrophobic fine aluminum oxide powder (BET specific surface area: 170 $m^2/g$) having been treated with 25 parts by weight of i-$C_4H_9Si(OCH_3)_3$ was added to 100 parts by weight of the above magenta toner particles (resin particles) to obtain magenta toner 23. Magenta developer 23 was obtained in the same way. The results of measurement and evaluation are shown in Table 3(A) and 3(B).

This toner showed substantially the same fixing performance as the magenta toner of Example 1. In the image reproduction in a low-temperature low-humidity environment, however, the toner showed a little lowering of halftone reproducibility and fine-line reproducibility, and images which were somewhat coarse as a whole were obtained.

Comparative Example 1

Magenta toner 24 was prepared in the same manner as in Example 1 except that in place of the Resin-(1) hybrid resin the Resin-(4) hybrid resin was used. Magenta developer 24 was obtained in the same way. The results of measurement and evaluation are shown in Table 3(A) and 3(B).

The magenta toner 24 was comprised of a resin having a high Mw/Mn ratio, so that it had a high G' at 80° C. and was a very hard toner. This toner showed a poor OHP transparency and also a very poor low-temperature fixing performance.

Comparative Example 2

Magenta toner 25 was prepared in the same manner as in Example 1 except that in place of the Resin-(1) hybrid resin the Resin-(6) polyester resin was used. Magenta developer 25 was obtained in the same way. The results of measurement and evaluation are shown in Table 3(A) and 3(B).

The magenta toner 25 was comprised of a resin having a low Mw/Mn ratio, so that it had a low G' at 120 to 180° C. and, in the fixing test, the recording paper wound around the upper roller at a low fixing temperature (140° C.).

Comparative Example 3

Magenta toner 26 was prepared in the same manner as in Example 1 except that the compound (3-1) was not added and, using only the compound (1-1), the toner was so prepared that the pigment was in a proportion of 6 parts by weight with respect to the whole resin. Magenta developer 26 was obtained in the same way. Evaluation was made in the same way. As a result, a little low image density of 1.52 was obtained at the same development contrast as that in Example 1. Accordingly, the development contrast potential was raised to 360 V to obtain the image density of 1.70. The color tone at this image density shifted greatly to a tinge of red compared with that of Example 1, and the toner was unsuitable as a magenta toner for full-color images. More specifically, the color tone of images was a*=68.2, b*=5.6 and L*=45.8. The magenta toner 26 provided a poor saturation and also had a greatly low reproducibility of flesh color. Other results of measurement and evaluation are shown in Table 3(A) and 3(B).

Comparative Example 4

Magenta toner 27 was prepared in the same manner as in Example 1 except that the compound (1-1) was not added and, using only the compound (3-1), the toner was so prepared that the pigment was in a proportion of 6 parts by weight with respect to the whole resin. Magenta developer 27 was obtained in the same way. Evaluation was made in the same way. As a result, though a sharp-magenta color toner was obtained, the color tone shifted greatly to a tinge of blue compared with the magenta color tone of process inks. This toner showed a superior blue-color reproducibility, but showed a low color reproducibility in the red region. More specifically, the color tone of images at the image density of 1.70 was a*=74.6, b*=−22.4 and L*=43.8. Other results of measurement and evaluation are shown in Table 3(A) and 3(B).

Comparative Example 5

Magenta toner 28 was prepared in the same manner as in Example 1 except that in place of the compounds (1-1) and (3-1) the compound (2-1) was used and the toner was so prepared that the compound was in an amount of 4 parts by weight based on the weight of the resin. Magenta developer 28 was obtained in the same way. Evaluation was made in the same way. As a result, the magenta toner 28 had a high coloring power, but was strongly tinged with red and showed a poor color reproducibility in the blue region. Also, this toner afforded a poor light-fastness to have changed greatly in tinges as a result of irradiation by light for 100 hours. Other results of measurement and evaluation are shown in Table 3(A) and 3(B).

Example 24

Magenta toner 29 was prepared in the same manner as in Example 1 except that in place of the compound (1-1) the compound (2-1) was used. Magenta developer 29 was obtained in the same way. The results of measurement on the toner and the results of evaluation made in the same way are shown in Table 3(A) and 3(B).

As to the color tone of images obtained, intended results were obtained. More specifically, it was a*=72.2, b*=−0.8 and L*=45.3.

Examples 25 to 28

Magenta toners 30 to 33 were prepared in the same manner as in Example 24 except that in place of the Resin-(1) hybrid resin the Resin-(2) hybrid resin, the Resin-(3) hybrid resin, the Resin-(5) polyester resin and the Resin-(7) vinyl resin were used, respectively. Magenta developers 30 to 33 were obtained in the same way. The results of measurement on the toners and the results of evaluation made in the same way are shown in Table 3(A) and 3(B).

Example 29

Magenta toner 34 was prepared in the same manner as in Example 24 except that the toner was so prepared that the mixing proportion of the compound (2-1) and the compound (3-1) came finally to be 1:9. Magenta developer 34 was obtained in the same way. The color tone was evaluated in the same way. As a result, the color tone at the image density of 1.70 shifted to a tinge of blue compared with that of Example 24, but was well on a level tolerable in practical use, and red was also in a good reproducibility. More specifically, the color tone of images was a*=71.2, b*=−11.8 and L*=45.5. Other results of measurement and evaluation are shown in Table 3(A) and 3(B).

Example 30

Magenta toner 35 was prepared in the same manner as in Example 24 except that the toner was so prepared that the mixing proportion of the compound (2-1) and the compound (3-1) came finally to be 4:6. Magenta developer 35 was obtained in the same way. The color tone was evaluated in the same way. As a result, the color tone at the image density of 1.70 shifted to a tinge of red compared with that of Example 24, but was well on a level tolerable in practical use, and reproducibility of blue was also of no problem. More specifically, the color tone of images was a*−70.8, b*=4.9 and L*=43.7. Other results of measurement and evaluation are shown in Table 3(A) and 3(B).

Example 31

Magenta toner 36 was prepared in the same manner as in Example 24 except that the toner was so prepared that the mixing proportion of the compound (2-1) and the compound (3-1) came finally to be 6:4. Magenta developer 36 was obtained in the same way. The color tone was evaluated in the same way. As a result, the color tone at the image density of 1.70 shifted fairly to a tinge of red compared with that of Example 24 and blue was in a low reproducibility, which, however, were barely on a level tolerable in practical use. More specifically, the color tone of images was a*=70.7, b*=7.4 and L*=43.5. Other results of measurement and evaluation are shown in Table 3(A) and 3(B).

Example 32

Magenta toner 37 was prepared in the same manner as in Example 24 except that in place of the Wax-(A) purified normal paraffin wax the Wax-(B) ester wax was used. Magenta developer 37 was obtained in the same way. The results of measurement on the toner and the results of evaluation made in the same way are shown in Table 3(A) and 3(B).

Example 33

Magenta toner 38 was prepared in the same manner as in Example 24 except that in place of the Wax-(A) purified normal paraffin wax the Wax-(D) polyethylene wax was used. Magenta developer 38 was obtained in the same way. The results of measurement on the toner and the results of evaluation made in the same way are shown in Table 3(A) and 3(B).

Example 34

Magenta toner 39 was prepared in the same manner as in Example 24 except that the aluminum compound of di-tert-butylsalicylic acid was added in a smaller amount of 2 parts by weight. Magenta developer 39 was obtained in the same way. The results of measurement and evaluation are shown in Table 3(A) and 3(B).

A slightly inferior result was obtained in respect of anti-blocking properties, but not on a level problematic in practical use.

Example 35

Magenta toner 40 was prepared in the same manner as in Example 24 except that 4 parts by weight of a zinc compound of di-tert-butylsalicylic acid was used instead. Magenta developer 40 was obtained in the same way. The results of measurement and evaluation are shown in Table 3(A) and 3(B).

A slightly inferior result was obtained in respect of anti-blocking properties, but not on a level problematic in practical use. Also, in the fixing test, the offsetting temperature on the high-temperature side was lower by about 30° C. than that of the magenta toner 29 of Example 24, but on a level tolerable in practical use.

In the 10,000-sheet running test made in a low-temperature low-humidity environment, the magenta toner 40 showed a tendency for charge-up and showed a tendency of a gradual lowering of image density with progress of the running, but on a level tolerable in practical use.

Example 36

Magenta toner 41 was prepared in the same manner as in Example 24 except that in place of the Resin-(1) hybrid resin the Resin-(2) hybrid resin was used and in place of the Wax-(A) purified normal paraffin wax the Wax-(C) paraffin wax was used. Magenta developer 41 was obtained in the same way. The results of measurement and evaluation are shown in Table 3(A) and 3(B).

An inferior result was obtained in respect of anti-blocking properties, which was barely on a level tolerable in practical use. Also, in the fixing test, the offsetting temperature on the high-temperature side was lower by about 30° C. than that of the magenta toner 24 of Example 24, but on a level tolerable in practical use.

Example 37

Magenta toner 42 was prepared in the same manner as in Example 24 except that in place of the Resin-(1) hybrid resin the Resin-(2) hybrid resin was used and in place of the Wax-(A) purified normal paraffin wax the Wax-(E) alcohol-modified PE wax was used. Magenta developer 42 was obtained in the same way. The results of measurement and evaluation are shown in Table 3(A) and 3(B).

The magenta toner 42 showed a tendency for the OHP transparency to be slightly low because of an influence of the crystallizability of the wax. It also showed a lowering of fixing performance on the low-temperature side, but is barely on a level tolerable in practical use.

Example 38

Magenta toner 43 was prepared in the same manner as in Example 36 except that the Wax-(C) paraffin wax was not used. Magenta developer 43 was obtained in the same way. The results of measurement and evaluation are shown in Table 3(A) and 3(B).

The magenta toner 43 was greatly deteriorated in anti-offset properties on the high-temperature side because it did not contain any wax, and also showed a lowering of fixing performance on the low-temperature side, which, however, were barely on a level tolerable in practical use.

Example 39

The same magenta toner particles (classified product) except having a weight-average particle diameter of 4.7 $\mu$m in its particle size distribution were prepared in the same manner as in Example 24. In order to improve fluidity and provide chargeability, 1.2 parts by weight of hydrophobic fine aluminum oxide powder (BET specific surface area: 170 $m^2/g$) having been treated with 25 parts by weight of $i\text{-}C_4H_9Si(OCH_3)_3$ was added to 100 parts by weight of the above magenta toner particles (resin particles) to obtain magenta toner 44. Magenta developer 44 was obtained in the same way. The results of measurement and evaluation are shown in Table 3(A) and 3(B).

This toner showed substantially the same fixing performance as the magenta toner of Example 24. In the 10,000-sheet running test made in a low-temperature and low-humidity environment, however, the toner showed a tendency for charge-up and showed a little decrease in image density with the progress of the running.

Example 40

The same magenta toner particles (classified product) except having a weight-average particle diameter of 9.7 $\mu$m in its particle size distribution were prepared in the same manner as in Example 24. In order to improve fluidity and provide chargeability, 0.8 part by weight of hydrophobic fine aluminum oxide powder (BET specific surface area: 170 $m^2/g$) having been treated with 25 parts by weight of $i\text{-}C_4H_9Si(OCH_3)_3$ was added to 100 parts by weight of the above magenta toner particles (resin particles) to obtain magenta toner 45. Magenta developer 45 was obtained in the same way. The results of measurement and evaluation are shown in Table 3(A) and 3(B).

This toner showed substantially the same fixing performance as the magenta toner of Example 24. In the image reproduction in a low-temperature and low-humidity environment, however, the toner showed a little deterioration in halftone reproducibility, and images which were somewhat coarse as a whole were obtained, but on a level tolerable in practical use.

Example 41

The same magenta toner particles (classified product) except having a weight-average particle diameter of 3.8 $\mu$m in its particle size distribution were prepared in the same manner as in Example 24. In order to improve fluidity and provide chargeability, 1.3 parts by weight of hydrophobic fine aluminum oxide powder (BET specific surface area: 170 $m^2/g$) having been treated with 25 parts by weight of $i\text{-}C_4H_9Si(OCH_3)_3$ was added to 100 parts by weight of the above magenta toner particles (resin particles) to obtain magenta toner 46. Magenta developer 46 was obtained in the same way. The results of measurement and evaluation are shown in Table 3(A) and 3(B).

This toner showed a fixing performance narrower by 10° C. on both the low-temperature side and the high-temperature side than the magenta toner of Example 24, but substantially the same results were obtained. In the 10,000-sheet running test made in a low-temperature and low-humidity environment, however, the magenta toner 46 showed a tendency for charge-up and showed a decrease in image density with the progress of the running, also causing a little fog in the midst of the running.

Example 42

The same magenta toner particles (classified product) but having a weight-average particle diameter of 10.6 $\mu$m in its particle size distribution were prepared in the same manner as in Example 24. In order to improve fluidity and provide chargeability, 0.7 part by weight of hydrophobic fine aluminum oxide powder (BET specific surface area: 170 $m^2/g$) having been treated with 25 parts by weight of $i\text{-}C_4H_9Si(OCH_3)_3$ was added to 100 parts by weight of the above magenta toner particles (resin particles) to obtain magenta toner 47. Magenta developer 47 was obtained in the same way. The results of measurement and evaluation are shown in Table 3(A) and 3(B).

This toner showed substantially the same fixing performance as the magenta toner of Example 24. In the image reproduction in a low-temperature low-humidity environment, however, the toner showed a little deterioration in halftone reproducibility and fine-line reproducibility, and images which were somewhat coarse as a whole were obtained.

Comparative Example 6

Magenta toner 48 was prepared in the same manner as in Example 24 except that in place of the Resin-(1) hybrid resin the Resin-(4) hybrid resin was used. Magenta developer 48 was obtained in the same way. The results of measurement and evaluation are shown in Table 3(A) and 3(B).

The magenta toner 48 was made up of a resin having a high Mw/Mn ratio, so that it had a high G' at 80° C. and was a very hard toner. This toner showed a poor OHP transparency and also a very poor low-temperature fixing performance.

Comparative Example 7

Magenta toner 49 was prepared in the same manner as in Example 24 except that in place of the Resin-(1) hybrid resin the Resin-(6) polyester resin was used. Magenta developer 49 was obtained in the same way. The results of measurement and evaluation are shown in Table 3(A) and 3(B).

The magenta toner 49 was made up of a resin having a low Mw/Mn ratio, so that it had a low G' at 120 to 180° C. and, in the fixing test, the recording paper wound around the upper roller at a low fixing temperature (140° C).

Comparative Example 8

Magenta toner 50 was prepared in the same manner as in Example 1 except that in place of the compounds (1-1) and (3-1) only the compound (3-2) was used and the toner was so prepared that the pigment was in a proportion of 6 parts by weight with respect to the whole resin. Magenta developer 50 was obtained in the same way. Evaluation was made in the same way. As a result, the color tone shifted to a tinge of blue compared with that of Example 1, and the toner was unsuitable as a magenta toner for full-color images. More specifically, the color tone of images was a*=67.2, b*=−3.8 and L*=46.8, showing a poor saturation. Also, the magenta toner 50 had so low a coloring power as to provide only a low image density of 1.37 at the same development contrast as that in Example 1. Other results of measurement and evaluation are shown in Table 3(A) and 3(B).

Example 43

Magenta toner 50 was prepared in the same manner as in Example 1 except that in place of the compound (3-1) the compound (3-2) was used. Magenta developer 50 was obtained in the same way. The results of measurement on the toner and the results of evaluation made in the same way are shown in Table 3(A) and 3(B).

As to the color tone of images obtained, intended results were obtained. More specifically, it was a*=73.1, b*=3.8 and L*=46.2.

Examples 44 to 47

Magenta toners 51 to 54 were prepared in the same manner as in Example 43 except that in place of the Resin-(1) hybrid resin the Resin-(2) hybrid resin, the Resin-(3) hybrid resin, the Resin-(5) polyester resin and the Resin-(7) vinyl resin were used, respectively. Magenta developers 51 to 54 were obtained in the same way. The results of measurement on the toners and the results of evaluation made in the same way are shown in Table 3(A) and 3(B).

Example 48

Magenta toner 55 was prepared in the same manner as in Example 43 except that the toner was so prepared that the mixing proportion of the compound (1-1) and the compound (3-2) came finally to be 1:9. Magenta developer 55 was obtained in the same way. The color tone was evaluated in the same way. As a result, the color tone at the image density of 1.70 had a little low saturation compared with that of Example 43, but was well on a level tolerable in practical use, and red was also in a good reproducibility. More specifically, the color tone of images was a*=70.2, b*=1.2 and L*=44.2. Other results of measurement and evaluation are shown in Table 3(A) and 3(B).

Example 49

Magenta toner 56 was prepared in the same manner as in Example 43 except that the toner was so prepared that the mixing proportion of the compound (1-1) and the compound (3-2) came finally to be 4:6. Magenta developer 56 was obtained in the same way. The color tone was evaluated in the same way. As a result, the color tone at the image density of 1.70 shifted to a tinge of red compared with that of Example 43, but was well on a level tolerable in practical use, and reproducibility of blue was also of no problem. More specifically, the color tone of images was a*=75.2, b*=4.2 and L*=45.2. Other results of measurement and evaluation are shown in Table 3(A) and 3(B).

Example 50

Magenta toner 57 was prepared in the same manner as in Example 43 except that the toner was so prepared that the mixing proportion of the compound (1-1) and the compound (3-2) came finally to be 6:4. Magenta developer 57 was obtained in the same way. The color tone was evaluated in the same way. As a result, the color tone at the image density of 1.70 shifted considerably to a tinge of red compared with that of Example 43, but was well on a level tolerable in practical use, and reproducibility of blue was also of no problem. More specifically, the color tone of images was a*=76.2, b*=4.6 and L*=45.3. Other results of measurement and evaluation are shown in Table 3(A) and 3(B).

Example 51

Magenta toner 58 was prepared in the same manner as in Example 43 except that in place of the Wax-(A) purified normal paraffin wax the Wax-(B) ester wax was used. Magenta developer 58 was obtained in the same way. The results of measurement on the toner and the results of evaluation made in the same way are shown in Table 3(A) and 3(B).

Example 52

Magenta toner 59 was prepared in the same manner as in Example 43 except that in place of the Wax-(A) purified normal paraffin wax the Wax-(D) polyethylene wax was used. Magenta developer 59 was obtained in the same way. The results of measurement on the toner and the results of evaluation made in the same way are shown in Table 3(A) and 3(B).

Example 53

Magenta toner 60 was prepared in the same manner as in Example 43 except that the aluminum compound of di-tert-butylsalicylic acid was added in a smaller amount of 2 parts by weight. Magenta developer 60 was obtained in the same way. The results of measurement and evaluation are shown in Table 3(A) and 3(B).

A slightly inferior result was obtained in respect of anti-blocking properties, but not on a level problematic in practical use.

Example 54

Magenta toner 61 was prepared in the same manner as in Example 43 except that 4 parts by weight of a zinc compound of di-tert-butylsalicylic acid was used instead. Magenta developer 61 was obtained in the same way. The results of measurement and evaluation are shown in Table 3(A) and 3(B).

A slightly inferior result was obtained in respect of anti-blocking properties, but not on a level problematic in practical use. Also, in the fixing test, the offsetting temperature on the high-temperature side was lower by about 40° C. than that of the magenta toner 50 of Example 43, but barely on a level tolerable in practical use.

In the 10,000-sheet running test made in a low-temperature and low-humidity environment, the magenta toner 61 showed a tendency for charge-up and showed a tendency of a gradual lowering of image density with progress of the running, but was on a level tolerable in practical use.

Examples 55 to 58

Magenta toners 62 to 65 were prepared in the same manner as in Example 43 except that in place of the pigment of compound (1-1) the pigment of compound (1-2), the pigment of compound (1-3), the pigment of compound (1-4), the pigment of compound (1-5) were used, respectively. Magenta developers 62 to 65 were obtained in the same way. The results of measurement on the toners and the results of evaluation made in the same way are shown in Table 3(A) and 3(B).

Example 59

Magenta toner 66 was prepared in the same manner as in Example 43 except that in place of the Resin-(1) hybrid resin the Resin-(2) hybrid resin was used and in place of the Wax-(A) purified normal paraffin wax the Wax-(C) paraffin wax was used. Magenta developer 66 was obtained in the same way. The results of measurement and evaluation are shown in Table 3(A) and 3(B).

An inferior result was obtained in respect of anti-blocking properties, which was barely on a level tolerable in practical use. Also, in the fixing test, the offsetting temperature on the high-temperature side was lower by about 30° C. than that of the magenta toner 50 of Example 43, but on a level tolerable in practical use.

Example 60

Magenta toner 67 was prepared in the same manner as in Example 43 except that in place of the Resin-(1) hybrid resin the Resin-(2) hybrid resin was used and in place of the Wax-(A) purified normal paraffin wax the Wax-(E) alcohol-modified PE wax was used. Magenta developer 67 was obtained in the same way. The results of measurement and evaluation are shown in Table 3(A) and 3(B).

The magenta toner 67 showed a tendency of providing a slightly low OHP transparency because of an influence of the crystallizability of the wax. It also showed a lowering of fixing performance on the low-temperature side, but was barely on a level tolerable in practical use.

Example 61

Magenta toner 68 was prepared in the same manner as in Example 59 except that the Wax-(C) paraffin wax was not used. Magenta developer 68 was obtained in the same way. The results of measurement and evaluation are shown in Table 3(A) and 3(B).

The magenta toner 68 was greatly deteriorated in anti-offset properties on the high-temperature side because it did not contain any wax, and also showed a lowering of fixing performance on the low-temperature side, which, however, were barely on a level tolerable in practical use.

Example 62

The same magenta toner particles (classified product) except having a weight-average particle diameter of 4.8 $\mu$m in its particle size distribution were prepared in the same manner as in Example 43. In order to improve fluidity and provide chargeability, 1.2 parts by weight of hydrophobic fine aluminum oxide powder (BET specific surface area: 170 $m^2/g$) having been treated with 25 parts by weight of $i\text{-}C_4H_9Si(OCH_3)_3$ was added to 100 parts by weight of the above magenta toner particles (resin particles) to obtain magenta toner 69. Magenta developer 69 was obtained in the same way. The results of measurement and evaluation are shown in Table 3(A) and 3(B).

This toner showed substantially the same fixing performance as the magenta toner of Example 43. In the 10,000-sheet running test made in a and low-temperature low-humidity environment, however, the toner showed a tendency for charge-up and showed a little decrease in image density with the progress of the running.

Example 63

The same magenta toner particles (classified product) but having a weight-average particle diameter of 9.8 $\mu$m in its particle size distribution were prepared in the same manner as in Example 43. In order to improve fluidity and provide chargeability, 0.8 part by weight of hydrophobic fine aluminum oxide powder (BET specific surface area: 170 $m^2/g$) having been treated with 25 parts by weight of $i\text{-}C_4H_9Si(OCH_3)_3$ was added to 100 parts by weight of the above magenta toner particles (resin particles) to obtain magenta toner 70. Magenta developer 70 was obtained in the same way. The results of measurement and evaluation are shown in Table 3(A) and 3(B).

This toner showed substantially the same fixing performance as the magenta toner of Example 43. In the image reproduction in a low-temperature and low-humidity environment, however, the toner showed a little lowering of halftone reproducibility, and images which were somewhat coarse as a whole were obtained, but on a level tolerable in practical use.

Example 64

The same magenta toner particles (classified product) but having a weight-average particle diameter of 3.9 $\mu$m in its particle size distribution were prepared in the same manner as in Example 43. In order to improve fluidity and provide chargeability, 1.3 parts by weight of hydrophobic fine aluminum oxide powder (BET specific surface area: 170 $m^2/g$) having been treated with 25 parts by weight of $i\text{-}C_4H_9Si(OCH_3)_3$ was added to 100 parts by weight of the above magenta toner particles (resin particles) to obtain magenta toner 71. Magenta developer 71 was obtained in the same way. The results of measurement and evaluation are shown in Table 3(A) and 3(B).

This toner showed a fixing performance narrower by 10° C. on both the low-temperature side and the high-temperature side than the magenta toner of Example 43, but substantially the same results were obtained. In the 10,000-sheet running test made in a low-temperature and low-humidity environment, however, the magenta toner 71 showed a tendency for charge-up and showed a decrease in image density with progress of the running, also causing a little fog in the midst of the running.

Example 65

The same magenta toner particles (classified product) except having a weight-average particle diameter of 10.5 $\mu$m in its particle size distribution were prepared in the same manner as in Example 43. In order to improve fluidity and provide chargeability, 0.7 part by weight of hydrophobic fine aluminum oxide powder (BET specific surface area: 170 $m^2/g$) having been treated with 25 parts by weight of $i\text{-}C_4H_9Si(OCH_3)_3$ was added to 100 parts by weight of the above magenta toner particles (resin particles) to obtain magenta toner 72. Magenta developer 72 was obtained in the same way. The results of measurement and evaluation are shown in Table 3(A) and 3(B).

This toner showed substantially the same fixing performance as the magenta toner of Example 43. In the image reproduction in a low-temperature and low-humidity environment, however, the toner showed a little lowering of halftone reproducibility and fine-line reproducibility, and images which were somewhat coarse as a whole were obtained.

Comparative Example 8

Magenta toner 73 was prepared in the same manner as in Example 43 except that in place of the Resin-(1) hybrid resin the Resin-(4) hybrid resin was used. Magenta developer 73 was obtained in the same way. The results of measurement and evaluation are shown in Table 3(A) and 3(B).

The magenta toner 73 was made up of a resin having a high Mw/Mn ratio, so that it had a high G' at 80° C. and was a very hard toner. This toner showed a poor OHP transparency and also a very poor low-temperature fixing performance.

Comparative Example 9

Magenta toner 74 was prepared in the same manner as in Example 43 except that in place of the Resin-(1) hybrid resin the Resin-(6) polyester resin was used. Magenta developer 74 was obtained in the same way. The results of measurement and evaluation are shown in Table 3(A) and 3(B).

The magenta toner 74 was comprised of a resin having a low Mw/Mn ratio, so that it had a low G' at 120 to 180° C. and, in the fixing test, the recording paper wound around the upper roller at a low fixing temperature (140° C.).

Example 66

Magenta toner 75 was prepared in the same manner as in Example 43 except that in place of the compound (1-1) the compound (2-1) was used. Magenta developer 75 was obtained in the same way. The results of measurement on the toner and the results of evaluation made in the same way are shown in Table 3(A) and 3(B).

As to the color tone of images obtained, intended results were obtained. More specifically, it was a*−73.2, b*=4.2 and L*=45.1.

Examples 67 to 70

Magenta toners 76 to 79 were prepared in the same manner as in Example 66 except that in place of the Resin-(1) hybrid resin the Resin-(2) hybrid resin, the Resin-(3) hybrid resin, the Resin-(5) polyester resin and the Resin-(7) vinyl resin were used, respectively. Magenta developers 76 to 79 were obtained in the same way. The results of measurement on the toners and the results of evaluation made in the same way are shown in Table 3(A) and 3(B).

Example 71

Magenta toner 80 was prepared in the same manner as in Example 66 except that the toner was so prepared that the mixing proportion of the compound (2-1) and the compound (3-2) came finally to be 1:9. Magenta developer 80 was obtained in the same way. The color tone was evaluated in the same way. As a result, the color tone at the image density of 1.70 shifted to a tinge of blue compared with that of Example 66, but was well on a level tolerable in practical use, and red was also good in its reproducibility. More specifically, the color tone of images was a*=70.1, b*=2.2 and L*=43.2. Other results of measurement and evaluation are shown in Table 3(A) and 3(B).

Example 72

Magenta toner 81 was prepared in the same manner as in Example 66 except that the toner was so prepared that the mixing proportion of the compound (2-1) and the compound (3-2) came finally to be 4:6. Magenta developer 81 was obtained in the same way. The color tone was evaluated in the same way. As a result, the color tone at the image density of 1.70 shifted to a tinge of red compared with that of Example 66, but was well on a level tolerable in practical use, and reproducibility of blue was also of no problem. More specifically, the color tone of images was a*=74.2, b*=5.9 and L*=43.6. Other results of measurement and evaluation are shown in Table 3(A) and 3(B).

Example 73

Magenta toner 82 was prepared in the same manner as in Example 66 except that the toner was so prepared that the mixing proportion of the compound (2-1) and the compound (3-2) came finally to be 6:4. Magenta developer 82 was obtained in the same way. The color tone was evaluated in the same way. As a result, the color tone at the image density of 1.70 shifted considerably to a tinge of red compared with that of Example 66 and blue was low in its reproducibility, which, however, were barely on a level tolerable in practical use. More specifically, the color tone of images was a*=76.3, b*=6.3 and L*=46.2. Other results of measurement and evaluation are shown in Table 3(A) and 3(B).

Example 74

Magenta toner 83 was prepared in the same manner as in Example 66 except that in place of the Wax-(A) purified normal paraffin wax the Wax-(B) ester wax was used. Magenta developer 83 was obtained in the same way. The results of measurement on the toner and the results of evaluation made in the same way are shown in Table 3(A) and 3(B).

Example 75

Magenta toner 84 was prepared in the same manner as in Example 66 except that in place of the Wax-(A) purified normal paraffin wax the Wax-(D) polyethylene wax was used. Magenta developer 84 was obtained in the same way. The results of measurement on the toner and the results of evaluation made in the same way are shown in Table 3(A) and 3(B).

Example 76

Magenta toner 85 was prepared in the same manner as in Example 66 except that the aluminum compound of di-tert-butylsalicylic acid was added in a smaller amount of 2 parts by weight. Magenta developer 85 was obtained in the same way. The results of measurement and evaluation are shown in Table 3(A) and 3(B).

A slightly inferior result was obtained in respect of anti-blocking properties, but not on a level problematic in practical use.

Example 77

Magenta toner 86 was prepared in the same manner as in Example 66 except that 4 parts by weight of a zinc compound of di-tert-butylsalicylic acid was used instead. Magenta developer 86 was obtained in the same way. The results of measurement and evaluation are shown in Table 3(A) and 3(B).

A slightly inferior result was obtained in respect of anti-blocking properties, but not on a level problematic in practical use. Also, in the fixing test, the offsetting temperature on the high-temperature side was lower by about 30° C. than that of the magenta toner 75 of Example 66, but on a level tolerable in practical use.

In the 10,000-sheet running test made in a low-temperature low-humidity environment, the magenta toner 86 showed a tendency for charge-up and showed a tendency for gradual decrease in image density with the progress of the running, but was on a level tolerable in practical use.

Example 78

Magenta toner 87 was prepared in the same manner as in Example 66 except that in place of the Resin-(1) hybrid resin the Resin-(2) hybrid resin was used and in place of the Wax-(A) purified normal paraffin wax the Wax-(C) paraffin wax was used. Magenta developer 87 was obtained in the same way. The results of measurement and evaluation are shown in Table 3(A) and 3(B).

An inferior result was obtained in respect of anti-blocking properties, which was barely on a level tolerable in practical use. Also, in the fixing test, the offsetting temperature on the high-temperature side was lower by about 40° C. than that of the magenta toner 75 of Example 66, but barely on a level tolerable in practical use.

Example 79

Magenta toner 88 was prepared in the same manner as in Example 66 except that in place of the Resin-(1) hybrid resin the Resin-(2) hybrid resin was used and in place of the Wax-(A) purified normal paraffin wax the Wax-(E) alcohol-modified PE wax was used. Magenta developer 88 was obtained in the same way. The results of measurement and evaluation are shown in Table 3(A) and 3(B).

The magenta toner 88 showed a tendency for the OHP transparency to be slightly low because of an influence of the crystallizability of the wax. It also showed a lowering of fixing performance on the low-temperature side, but was barely on a level tolerable in practical use.

Example 80

Magenta toner 89 was prepared in the same manner as in Example 78 except that the Wax-(C) paraffin wax was not used. Magenta developer 89 was obtained in the same way. The results of measurement and evaluation are shown in Table 3(A) and 3(B).

The magenta toner 89 was greatly deteriorated in anti-offset properties on the high-temperature side because it did not contain any wax, and also showed a lowering of fixing performance on the low-temperature side, which, however, were barely on a level tolerable in practical use.

Example 81

The same magenta toner particles (classified product) except having a weight-average particle diameter of 4.7 $\mu$m in its particle size distribution were prepared in the same manner as in Example 66. In order to improve fluidity and provide chargeability, 1.2 parts by weight of hydrophobic fine aluminum oxide powder (BET specific surface area: 170 $m^2/g$) having been treated with 25 parts by weight of $i\text{-}C_4H_9Si(OCH_3)_3$ was added to 100 parts by weight of the above magenta toner particles (resin particles) to obtain magenta toner 90. Magenta developer 90 was obtained in the same way. The results of measurement and evaluation are shown in Table 3(A) and 3(B).

This toner showed substantially the same fixing performance as the magenta toner of Example 66. In the 10,000-sheet running test made in a low-temperature and low-humidity environment, however, the toner showed a tendency for charge-up and showed a little decrease in image density with the progress of the running.

Example 82

The same magenta toner particles (classified product) except having a weight-average particle diameter of 9.7 $\mu$m in its particle size distribution were prepared in the same manner as in Example 66. In order to improve fluidity and provide chargeability, 0.8 part by weight of hydrophobic fine aluminum oxide powder (BET specific surface area: 170 $m^2/g$) having been treated with 25 parts by weight of $i\text{-}C_4H_9Si(OCH_3)_3$ was added to 100 parts by weight of the above magenta toner particles (resin particles) to obtain magenta toner 91. Magenta developer 91 was obtained in the same way. The results of measurement and evaluation are shown in Table 3(A) and 3(B).

This toner showed substantially the same fixing performance as the magenta toner of Example 66. In the image reproduction in a low-temperature and low-humidity environment, however, the toner showed a little lowering of halftone reproducibility, and images which were somewhat coarse as a whole were obtained, but on a level tolerable in practical use.

Example 83

The same magenta toner particles (classified product) but having a weight-average particle diameter of 3.8 $\mu$min its particle size distribution were prepared in the same manner as in Example 66. In order to improve fluidity and provide chargeability, 1.3 parts by weight of hydrophobic fine aluminum oxide powder (BET specific surface area: 170 $m^2/g$) having been treated with 25 parts by weight of $i\text{-}C_4H_9Si(OCH_3)_3$ was added to 100 parts by weight of the above magenta toner particles (resin particles) to obtain magenta toner 92. Magenta developer 92 was obtained in the same way. The results of measurement and evaluation are shown in Table 3(A) and 3(B).

This toner showed a narrower fixing performance on both the low-temperature side and the high-temperature side than the magenta toner of Example 66, but substantially the same results were obtained. In the 10,000-sheet running test made in a low-temperature low-humidity environment, however, the magenta toner showed a tendency for charge-up and showed a decrease in image density with the progress of the running, also causing a little fog in the midst of the running.

Example 84

The same magenta toner particles (classified product) except having a weight-average particle diameter of 10.6 $\mu$m in its particle size distribution were prepared in the same manner as in Example 66. In order to improve fluidity and provide chargeability, 0.7 part by weight of hydrophobic fine aluminum oxide powder (BET specific surface area: 170 $m^2/g$) having been treated with 25 parts by weight of $i\text{-}C_4H_9Si(OCH_3)_3$ was added to 100 parts by weight of the above magenta toner particles (resin particles) to obtain magenta toner 93. Magenta developer 93 was obtained in the same way. The results of measurement and evaluation are shown in Table 3(A) and 3(B).

This toner showed substantially the same fixing performance as the magenta toner of Example 66. In the image reproduction in a low-temperature low-humidity environment, however, the toner showed a little lowering of halftone reproducibility and fine-line reproducibility, and images which were somewhat coarse as a whole were obtained.

Comparative Example 10

Magenta toner 94 was prepared in the same manner as in Example 66 except that in place of the Resin-(1) hybrid resin the Resin-(4) hybrid resin was used. Magenta developer 94 was obtained in the same way. The results of measurement and evaluation are shown in Table 3(A) and 3(B).

The magenta toner 94 was made up of a resin having a high Mw/Mn ratio, so that it had a high G' at 80° C. and was a very hard toner. This toner showed a poor OHP transparency and also a very poor low-temperature fixing performance.

Comparative Example 11

Magenta toner 95 was prepared in the same manner as in Example 66 except that in place of the Resin-(1) hybrid resin the Resin-(6) polyester resin was used. Magenta developer 95 was obtained in the same way. The results of measurement and evaluation are shown in Table 3(A) and 3(B).

The magenta toner 95 was comprised of a resin having a low Mw/Mn ratio, so that it had a low G' at 120 to 180° C. and, in the fixing test, the recording paper wound around the upper roller at a low fixing temperature (140° C.).

Comparative Example 12

Magenta toner 96 was prepared in the same manner as in Example 43 except that in place of the compounds (1-1) and (3-1) only the compound (3-2) was used and the toner was so prepared that the pigment was in a proportion of 6 parts by weight with respect to the whole resin. Magenta developer 96 was obtained in the same way. Evaluation was made in the same way. As a result, the color tone shifted to a tinge of blue compared with that of Example 43, and the toner was unsuitable as a magenta toner for full-color images. More specifically, the color tone of images was a*=67.3, b*=−3.8 and L*=44.2, showing a poor saturation. Also, the magenta toner 96 had so low a coloring power as to provide only a low image density of 1.37 was obtained at the same development contrast as that in Example 43. Other results of measurement and evaluation are shown in Table 3(A) and 3(B).

Example 85

Magenta toner 97 was prepared in the same manner as in Example 1 except that the aluminum compound of di-tert-butylsalicylic acid was not added. Magenta developer 97 was obtained in the same way. The results of measurement and evaluation are shown in Table 3(A) and 3(B).

The magenta toner 97 was a little inferior in high-temperature anti-offset properties, but on a level not problematic in practical use. In the 10,000-sheet running test made in a high-temperature and high-humidity environment, however, the toner scatter began to be seen in the midst of the running.

TABLE 3(A)

| Toner | | Resin | Colorant [compounds part(s)] | Wax | Storage elastic modulus G' at 80° C. | Storage elastic modulus G' at 120–180° C. Minimum | Storage elastic modulus G' at 120–180° C. Maximum | 120-180° C. G'max/G'min | Maximum endothermic peak temp. (° C.) |
|---|---|---|---|---|---|---|---|---|---|
| Example: | | | | | | | | | |
| 1 | 1 | (1) | (1-1)/(3-1) = 1.8/4.2 | (A) | $5.1 \times 10^6$ | $3.8 \times 10^4$ | $1.3 \times 10^5$ | 3.42 | 73.2 |
| 2 | 2 | (2) | " | " | $5.9 \times 10^6$ | $4.6 \times 10^4$ | $2.3 \times 10^5$ | 5.00 | 73.2 |
| 3 | 3 | (3) | " | " | $4.5 \times 10^6$ | $4.7 \times 10^4$ | $2.1 \times 10^5$ | 4.49 | 72.6 |
| 4 | 4 | (5) | " | " | $8.8 \times 10^7$ | $2.9 \times 10^5$ | $6.3 \times 10^5$ | 2.17 | 72.9 |
| 5 | 5 | (7) | " | " | $7.1 \times 10^6$ | $6.3 \times 10^4$ | $8.8 \times 10^5$ | 13.97 | 74.1 |
| 6 | 6 | (1) | (1-1)/(3-1) = 0.6/5.4 | (A) | $4.8 \times 10^6$ | $3.2 \times 10^4$ | $1.1 \times 10^5$ | 3.43 | 73.2 |
| 7 | 7 | " | (1-1)/(3-1) = 2.4/3.6 | " | $5.5 \times 10^6$ | $4.2 \times 10^4$ | $1.7 \times 10^5$ | 4.05 | 73.1 |
| 8 | 8 | " | (1-1)/(3-1) = 3.6/2.4 | " | $5.8 \times 10^6$ | $4.5 \times 10^4$ | $1.8 \times 10^5$ | 4.00 | 73.2 |
| 9 | 9 | " | (1-1)/(3-1) = 1.8/4.2 | (B) | $8.5 \times 10^6$ | $2.6 \times 10^4$ | $1.8 \times 10^5$ | 6.92 | 72.5 |
| 10 | 10 | " | " | (D) | $7.2 \times 10^7$ | $3.0 \times 10^4$ | $1.7 \times 10^5$ | 5.67 | 96.3 |
| 11 | 11 | " | (1-1)/(3-1) = 1.8/4.2 | (A) | $3.6 \times 10^6$ | $2.3 \times 10^4$ | $2.1 \times 10^5$ | 9.13 | 73.2 |
| 12 | 12 | " | " | " | $3.2 \times 10^6$ | $1.1 \times 10^4$ | $2.1 \times 10^5$ | 19.09 | 73.8 |
| 13 | 13 | " | (1-2)/(3-1) = 1.8/4.2 | (A) | $5.1 \times 10^6$ | $3.5 \times 10^4$ | $1.4 \times 10^5$ | 4.00 | 73.2 |
| 14 | 14 | " | (1-3)/(3-1) = 1.8/4.2 | " | $6.3 \times 10^6$ | $3.8 \times 10^4$ | $2.3 \times 10^5$ | 6.05 | 73.2 |
| 15 | 15 | " | (1-4)/(3-1) = 1.8/4.2 | " | $5.0 \times 10^6$ | $3.7 \times 10^4$ | $1.3 \times 10^5$ | 3.51 | 73.5 |
| 16 | 16 | " | (1-5)/(3-1) = 1.8/4.2 | " | $5.0 \times 10^6$ | $3.6 \times 10^4$ | $1.3 \times 10^5$ | 3.61 | 73.1 |
| 17 | 17 | (2) | (1-1)/(3-1) = 1.8/4.2 | (C) | $3.2 \times 10^6$ | $9.5 \times 10^3$ | $4.8 \times 10^4$ | 5.05 | 59.2 |
| 18 | 18 | " | " | (E) | $6.8 \times 10^6$ | $4.8 \times 10^4$ | $3.3 \times 10^5$ | 6.88 | 110.3 |
| 19 | 19 | " | " | — | $6.1 \times 10^6$ | $5.2 \times 10^4$ | $2.3 \times 10^5$ | 4.42 | — |
| 20 | 20 | (1) | (1-1)/(3-1) = 1.8/4.2 | (A) | $5.1 \times 10^6$ | $3.8 \times 10^4$ | $1.3 \times 10^5$ | 3.42 | 73.2 |
| 21 | 21 | " | " | " | $5.2 \times 10^6$ | $3.8 \times 10^4$ | $1.3 \times 10^5$ | 3.42 | 73.2 |
| 22 | 22 | " | " | " | $5.2 \times 10^6$ | $3.8 \times 10^4$ | $1.3 \times 10^5$ | 3.42 | 73.1 |
| 23 | 23 | " | " | " | $5.2 \times 10^6$ | $3.8 \times 10^4$ | $1.3 \times 10^5$ | 3.42 | 73.2 |
| Comparative Example: | | | | | | | | | |
| 1 | 24 | (4) | (1-1)/(3-1) = 1.8/4.2 | (A) | $2.5 \times 10^8$ | $2.2 \times 10^5$ | $2.2 \times 10^6$ | 10.0 | 72.9 |
| 2 | 25 | (6) | " | " | $2.1 \times 10^6$ | $1.2 \times 10^3$ | $8.3 \times 10^3$ | 6.92 | 73.2 |
| 3 | 26 | (1) | (1-1) = 6 | " | $7.6 \times 10^6$ | $4.6 \times 10^4$ | $2.2 \times 10^5$ | 4.78 | 73.5 |
| 4 | 27 | " | (3-1) = 6 | " | $4.5 \times 10^6$ | $3.1 \times 10^4$ | $1.1 \times 10^5$ | 3.54 | 73.5 |
| 5 | 28 | " | (2-1) = 4 | " | $7.2 \times 10^6$ | $2.3 \times 10^4$ | $8.8 \times 10^4$ | 3.83 | 72.8 |
| Example: | | | | | | | | | |
| 24 | 29 | (1) | (2-1)/(3-1) = 1.8/4.2 | (A) | $5.6 \times 10^6$ | $4.0 \times 10^4$ | $1.6 \times 10^5$ | 4.00 | 73.2 |
| 25 | 30 | (2) | " | " | $5.9 \times 10^6$ | $4.7 \times 10^4$ | $2.5 \times 10^5$ | 5.32 | 73.2 |

TABLE 3(A)-continued

| Toner | | Resin | Colorant [compounds part(s)] | Wax | Storage elastic modulus G' at 80° C. | Storage elastic modulus G' at 120–180° C. Minimum | Storage elastic modulus G' at 120–180° C. Maximum | 120-180° C. G'max/G'min | Maximum endo-thermic peak temp. (° C.) |
|---|---|---|---|---|---|---|---|---|---|
| 26 | 31 | (3) | " | " | $4.5 \times 10^6$ | $4.8 \times 10^4$ | $2.3 \times 10^5$ | 4.79 | 72.6 |
| 27 | 32 | (5) | " | " | $8.8 \times 10^7$ | $3.0 \times 10^5$ | $6.5 \times 10^5$ | 2.17 | 73.2 |
| 28 | 33 | (7) | " | " | $7.1 \times 10^6$ | $6.4 \times 10^4$ | $8.8 \times 10^5$ | 13.75 | 74.1 |
| 29 | 34 | (1) | (2-1)/(3-1) = 0.6/5.4 | (A) | $4.9 \times 10^6$ | $3.3 \times 10^4$ | $1.6 \times 10^5$ | 4.85 | 73.2 |
| 30 | 35 | " | (2-1)/(3-1) = 2.4/3.6 | " | $5.7 \times 10^6$ | $4.4 \times 10^4$ | $2.3 \times 10^5$ | 5.23 | 73.1 |
| 31 | 36 | " | (2-1)/(3-1) = 3.6/2.4 | " | $6.0 \times 10^6$ | $4.6 \times 10^4$ | $2.0 \times 10^5$ | 4.35 | 73.2 |
| 32 | 37 | " | (2-1)/(3-1) = 1.8/4.2 | (B) | $8.5 \times 10^6$ | $2.7 \times 10^4$ | $2.0 \times 10^5$ | 7.41 | 72.4 |
| 33 | 38 | " | " | (D) | $7.2 \times 10^7$ | $3.1 \times 10^4$ | $1.9 \times 10^5$ | 6.13 | 96.0 |
| 34 | 39 | " | (2-1)/(3-1) = 1.8/4.2 | (A) | $3.6 \times 10^6$ | $2.7 \times 10^4$ | $2.4 \times 10^5$ | 8.89 | 73.6 |
| 35 | 40 | " | " | " | $3.2 \times 10^6$ | $8.1 \times 10^3$ | $2.2 \times 10^5$ | 27.16 | 73.8 |
| Example: | | | | | | | | | |
| 36 | 41 | (2) | (2-1)/(3-1) = 1.8/4.2 | (C) | $3.3 \times 10^6$ | $9.7 \times 10^3$ | $4.8 \times 10^4$ | 4.95 | 59.2 |
| 37 | 42 | " | " | (E) | $6.8 \times 10^6$ | $4.9 \times 10^4$ | $3.3 \times 10^5$ | 6.73 | 110.3 |
| 38 | 43 | " | " | — | $6.1 \times 10^6$ | $5.3 \times 10^4$ | $2.2 \times 10^5$ | 4.15 | — |
| 39 | 44 | (1) | (2-1)/(3-1) = 1.8/4.2 | (A) | $5.2 \times 10^6$ | $3.9 \times 10^4$ | $1.5 \times 10^5$ | 3.85 | 73.2 |
| 40 | 45 | " | " | " | $5.2 \times 10^6$ | $3.9 \times 10^4$ | $1.5 \times 10^5$ | 3.85 | 73.2 |
| 41 | 46 | " | " | " | $5.2 \times 10^6$ | $3.9 \times 10^4$ | $1.5 \times 10^5$ | 3.85 | 73.2 |
| 42 | 47 | " | " | " | $5.2 \times 10^6$ | $3.9 \times 10^4$ | $1.5 \times 10^5$ | 3.85 | 73.2 |
| Comparative Example: | | | | | | | | | |
| 6 | 48 | (4) | (2-1)/(3-1) = 1.8/4.2 | (A) | $2.5 \times 10^8$ | $2.3 \times 10^5$ | $2.3 \times 10^6$ | 10.0 | 72.6 |
| 7 | 49 | (6) | " | " | $2.1 \times 10^6$ | $1.4 \times 10^3$ | $8.5 \times 10^3$ | 6.07 | 73.1 |
| Example: | | | | | | | | | |
| 43 | 50 | (1) | (1-1)/(3-2) = 1.8/4.2 | (A) | $5.0 \times 10^6$ | $3.7 \times 10^4$ | $1.3 \times 10^5$ | 3.51 | 73.1 |
| 44 | 51 | (2) | " | " | $5.9 \times 10^6$ | $4.6 \times 10^4$ | $2.2 \times 10^5$ | 4.78 | 72.9 |
| 45 | 52 | (3) | " | " | $4.4 \times 10^6$ | $4.6 \times 10^4$ | $2.1 \times 10^5$ | 4.57 | 72.9 |
| 46 | 53 | (5) | " | " | $8.8 \times 10^7$ | $2.8 \times 10^5$ | $6.3 \times 10^5$ | 2.25 | 72.8 |
| 47 | 54 | (7) | " | " | $7.1 \times 10^6$ | $6.3 \times 10^4$ | $8.7 \times 10^5$ | 13.81 | 73.6 |
| 48 | 55 | (1) | (1-1)/(3-2) = 0.6/5.4 | (A) | $4.7 \times 10^6$ | $3.0 \times 10^4$ | $1.1 \times 10^5$ | 3.67 | 72.5 |
| 49 | 56 | " | (1-1)/(3-2) = 2.4/3.6 | " | $5.4 \times 10^6$ | $4.1 \times 10^4$ | $1.6 \times 10^5$ | 3.90 | 72.6 |
| 50 | 57 | " | (1-1)/(3-2) = 3.6/2.4 | " | $5.8 \times 10^6$ | $4.5 \times 10^4$ | $1.9 \times 10^5$ | 4.22 | 72.9 |
| 51 | 58 | " | (1-1)/(3-2) = 1.8/4.2 | (B) | $8.0 \times 10^6$ | $2.6 \times 10^4$ | $1.8 \times 10^5$ | 6.92 | 72.5 |
| 52 | 59 | " | " | (D) | $7.1 \times 10^7$ | $2.8 \times 10^4$ | $1.8 \times 10^5$ | 6.43 | 96.5 |
| 53 | 60 | " | (1-1)/(3-2) = 1.8/4.2 | (A) | $3.5 \times 10^6$ | $2.2 \times 10^4$ | $2.0 \times 10^5$ | 9.09 | 73.2 |
| 54 | 61 | " | " | " | $3.2 \times 10^6$ | $8.8 \times 10^3$ | $2.0 \times 10^5$ | 22.73 | 73.8 |
| 55 | 62 | " | (1-2)/(3-2) = 1.8/4.2 | (A) | $5.1 \times 10^6$ | $3.4 \times 10^4$ | $1.4 \times 10^5$ | 4.12 | 73.2 |
| Example: | | | | | | | | | |
| 56 | 63 | (1) | (1-3)/(3-2) = 1.8/4.2 | (A) | $6.2 \times 10^6$ | $3.8 \times 10^4$ | $2.3 \times 10^5$ | 6.05 | 73.2 |
| 57 | 64 | " | (1-4)/(3-2) = 1.8/4.2 | " | $5.1 \times 10^6$ | $3.9 \times 10^4$ | $1.2 \times 10^5$ | 3.08 | 73.5 |
| 58 | 65 | " | (1-5)/(3-2) = 1.8/4.2 | " | $5.2 \times 10^6$ | $3.6 \times 10^4$ | $1.5 \times 10^5$ | 4.17 | 73.1 |
| 59 | 66 | (2) | (1-1)/(3-2) = 1.8/4.2 | (C) | $3.4 \times 10^6$ | $9.0 \times 10^3$ | $4.4 \times 10^4$ | 4.89 | 59.6 |
| 60 | 67 | " | " | (E) | $6.8 \times 10^6$ | $4.7 \times 10^4$ | $3.5 \times 10^5$ | 7.45 | 110.2 |
| 61 | 68 | " | " | — | $5.5 \times 10^6$ | $5.5 \times 10^4$ | $2.6 \times 10^5$ | 4.73 | — |
| 62 | 69 | (1) | (1-1)/(3-2) = 1.8/4.2 | (A) | $5.1 \times 10^6$ | $3.5 \times 10^4$ | $1.2 \times 10^5$ | 3.43 | 72.9 |
| 63 | 70 | " | " | " | $5.1 \times 10^6$ | $3.5 \times 10^4$ | $1.2 \times 10^5$ | 3.43 | 72.9 |
| 64 | 71 | " | " | " | $5.1 \times 10^6$ | $3.5 \times 10^4$ | $1.2 \times 10^5$ | 3.43 | 72.9 |
| 65 | 72 | " | " | " | $5.1 \times 10^6$ | $3.5 \times 10^4$ | $1.2 \times 10^5$ | 3.43 | 72.9 |
| Comparative Example: | | | | | | | | | |
| 8 | 73 | (4) | (1-1)/(3-2) = 1.8/4.2 | (A) | $2.5 \times 10^8$ | $2.0 \times 10^5$ | $2.2 \times 10^6$ | 11.0 | 72.9 |
| 9 | 74 | (6) | " | " | $2.1 \times 10^6$ | $1.2 \times 10^3$ | $8.5 \times 10^3$ | 7.08 | 73.2 |
| Example: | | | | | | | | | |
| 66 | 75 | (1) | (2-1)/(3-2) = 1.8/4.2 | (A) | $5.1 \times 10^6$ | $3.8 \times 10^4$ | $1.6 \times 10^5$ | 4.21 | 73.2 |
| 67 | 76 | (2) | " | " | $6.0 \times 10^6$ | $4.6 \times 10^4$ | $2.5 \times 10^5$ | 5.43 | 73.6 |
| 68 | 77 | (3) | " | " | $4.5 \times 10^6$ | $4.7 \times 10^4$ | $2.1 \times 10^5$ | 4.47 | 72.9 |
| 69 | 78 | (5) | " | " | $8.8 \times 10^7$ | $3.0 \times 10^5$ | $6.3 \times 10^5$ | 2.10 | 72.6 |
| 70 | 79 | (7) | " | " | $7.1 \times 10^6$ | $6.3 \times 10^4$ | $8.8 \times 10^5$ | 13.97 | 74.0 |
| 71 | 80 | (1) | (2-1)/(3-2) = 0.6/5.4 | (A) | $4.8 \times 10^6$ | $3.2 \times 10^4$ | $1.8 \times 10^5$ | 5.63 | 73.2 |
| 72 | 81 | " | (2-1)/(3-2) = 2.4/3.6 | " | $5.6 \times 10^6$ | $4.2 \times 10^4$ | $2.3 \times 10^5$ | 5.48 | 73.1 |
| 73 | 82 | " | (2-1)/(3-2) = 3.6/2.4 | " | $5.8 \times 10^6$ | $4.5 \times 10^4$ | $2.4 \times 10^5$ | 5.33 | 73.2 |
| 74 | 83 | " | (2-1)/(3-2) = 1.8/4.2 | (B) | $8.5 \times 10^6$ | $2.6 \times 10^4$ | $2.3 \times 10^5$ | 8.85 | 72.6 |
| 75 | 84 | " | " | (D) | $7.3 \times 10^7$ | $3.0 \times 10^4$ | $2.8 \times 10^5$ | 9.33 | 97.2 |
| Example: | | | | | | | | | |
| 76 | 85 | (1) | (2-1)/(3-2) = 1.8/4.2 | (A) | $3.5 \times 10^6$ | $2.3 \times 10^4$ | $2.8 \times 10^5$ | 12.17 | 73.2 |
| 77 | 86 | " | " | " | $3.2 \times 10^6$ | $8.9 \times 10^3$ | $2.2 \times 10^5$ | 24.72 | 73.6 |

TABLE 3(A)-continued

| Toner | | Resin | Colorant [compounds part(s)] | Wax | Storage elastic modulus G' at 80° C. | Storage elastic modulus G' at 120–180° C. Minimum | Storage elastic modulus G' at 120–180° C. Maximum | 120-180° C. G'max/G'min | Maximum endo-thermic peak temp. (° C.) |
|---|---|---|---|---|---|---|---|---|---|
| 78 | 87 | (2) | (2-1)/(3-2) = 1.8/4.2 | (C) | $3.2 \times 10^6$ | $9.9 \times 10^3$ | $5.0 \times 10^4$ | 9.09 | 58.3 |
| 79 | 88 | " | " | (E) | $6.9 \times 10^6$ | $5.0 \times 10^4$ | $3.8 \times 10^5$ | 7.60 | 109.6 |
| 80 | 89 | " | " | — | $6.1 \times 10^5$ | $5.2 \times 10^4$ | $3.3 \times 10^5$ | 6.35 | — |
| 81 | 90 | (1) | (2-1)/(3-2) = 1.8/4.2 | (A) | $5.0 \times 10^6$ | $3.2 \times 10^4$ | $1.4 \times 10^5$ | 4.38 | 74.6 |
| 82 | 91 | " | " | " | $5.0 \times 10^6$ | $3.2 \times 10^4$ | $1.4 \times 10^5$ | 4.38 | 74.6 |
| 83 | 92 | " | " | " | $5.0 \times 10^6$ | $3.2 \times 10^4$ | $1.4 \times 10^5$ | 4.38 | 74.6 |
| 84 | 93 | " | " | " | $5.0 \times 10^6$ | $3.2 \times 10^4$ | $1.4 \times 10^5$ | 4.38 | 74.6 |
| Comparative Example: | | | | | | | | | |
| 10 | 94 | (4) | (2-1)/(3-2) = 1.8/4.2 | (A) | $2.2 \times 10^8$ | $2.2 \times 10^5$ | $2.2 \times 10^6$ | 10.0 | 72.9 |
| 11 | 95 | (6) | " | " | $2.1 \times 10^6$ | $1.5 \times 10^3$ | $7.6 \times 10^3$ | 5.07 | 73.2 |
| 12 | 96 | (1) | (3-2) = 6 | " | $5.5 \times 10^6$ | $4.2 \times 10^4$ | $1.9 \times 10^5$ | 4.52 | 73.5 |
| Example: | | | | | | | | | |
| 85 | 97 | (1) | (1-1)/(3-1) = 1.8/4.2 | (A) | $2.6 \times 10^6$ | $9.5 \times 10^3$ | $4.8 \times 10^4$ | 5.05 | 59.2 |

TABLE 3(B)

| | Fixing temperature range: Fixing start temp. (° C.) | Fixing temperature range: Offsetting temp. (° C.) | OHP transparency | light-fastness | Anti-blocking properties |
|---|---|---|---|---|---|
| Example: | | | | | |
| 1 | 120 | 210 | A | A | A |
| 2 | 120 | 220 | A | A | A |
| 3 | 120 | 210 | A | A | A |
| 4 | 140 | 230 | B | A | A |
| 5 | 120 | 190 | B | A | B |
| 6 | 120 | 210 | A | A | B |
| 7 | 120 | 210 | A | B | A |
| 8 | 120 | 210 | B | B | A |
| 9 | 130 | 200 | B | A | A |
| 10 | 130 | 210 | B | A | A |
| 11 | 110 | 180 | A | A | B |
| 12 | 110 | 180 | A | B | B |
| 13 | 120 | 200 | A | A | A |
| 14 | 130 | 210 | A | B | A |
| 15 | 120 | 200 | A | B | A |
| 16 | 120 | 200 | A | B | A |
| 17 | 110 | 180 | A | A | B |
| 18 | 150 | 200 | B | A | A |
| 19 | 120 | 170 | A | A | A |
| 20 | 120 | 200 | A | A | A |
| 21 | 120 | 210 | A | A | A |
| 22 | 130 | 190 | A | A | A |
| 23 | 120 | 210 | A | A | A |
| Comparative Example: | | | | | |
| 1 | 160 | 230 | C | A | A |
| 2 | 110 | 140 | A | A | C |
| 3 | 120 | 210 | B | C | A |
| 4 | 120 | 200 | A | A | A |
| 5 | 120 | 200 | B | C | A |
| Example: | | | | | |
| 24 | 120 | 210 | A | A | A |
| 25 | 120 | 210 | A | A | A |
| 26 | 120 | 210 | A | A | A |
| 27 | 140 | 230 | B | A | A |
| 28 | 120 | 190 | B | A | B |
| 29 | 120 | 210 | A | A | B |
| 30 | 120 | 200 | A | B | A |
| 31 | 120 | 210 | B | B | A |
| 32 | 130 | 200 | B | A | A |

TABLE 3(B)-continued

| | Fixing temperature range | | | | |
|---|---|---|---|---|---|
| | Fixing start temp. (° C.) | Offsetting temp. (° C.) | OHP transparency | light-fastness | Anti-blocking properties |
| 33 | 130 | 210 | B | A | A |
| 34 | 120 | 180 | A | A | B |
| 35 | 110 | 180 | A | B | B |
| Example: | | | | | |
| 36 | 110 | 170 | A | A | B |
| 37 | 140 | 200 | B | A | A |
| 38 | 140 | 180 | A | A | A |
| 39 | 120 | 200 | A | A | A |
| 40 | 120 | 210 | A | A | A |
| 41 | 130 | 190 | A | A | A |
| 42 | 120 | 210 | A | A | A |
| Comparative Example: | | | | | |
| 6 | 160 | 230 | C | A | A |
| 7 | 110 | 140 | A | A | C |
| Example: | | | | | |
| 43 | 120 | 210 | A | A | A |
| 44 | 120 | 220 | A | A | A |
| 45 | 120 | 200 | A | A | A |
| Example: | | | | | |
| 46 | 140 | 220 | B | A | A |
| 47 | 120 | 190 | B | A | B |
| 48 | 120 | 210 | A | A | B |
| 49 | 120 | 210 | A | B | A |
| 50 | 120 | 210 | B | B | A |
| 51 | 130 | 200 | B | A | A |
| 52 | 130 | 210 | B | A | A |
| 53 | 110 | 180 | A | A | B |
| 54 | 110 | 170 | A | B | B |
| 55 | 120 | 200 | A | A | A |
| Example: | | | | | |
| 56 | 130 | 200 | A | B | A |
| 57 | 120 | 200 | A | B | A |
| 58 | 120 | 200 | A | B | A |
| 59 | 110 | 180 | A | A | B |
| 60 | 150 | 200 | B | A | A |
| 61 | 120 | 170 | A | A | A |
| 62 | 120 | 200 | A | A | A |
| 63 | 120 | 210 | A | A | A |
| 64 | 130 | 190 | A | A | A |
| 65 | 120 | 210 | A | A | A |
| Comparative Example: | | | | | |
| 8 | 160 | 230 | C | A | A |
| 9 | 110 | 140 | A | A | C |
| Example: | | | | | |
| 66 | 120 | 210 | A | A | A |
| 67 | 120 | 220 | A | A | A |
| 68 | 120 | 210 | A | A | A |
| 69 | 140 | 230 | B | A | A |
| 70 | 120 | 190 | B | A | B |
| 71 | 120 | 210 | A | A | B |
| 72 | 120 | 210 | A | B | A |
| 73 | 120 | 210 | B | B | A |
| 74 | 130 | 200 | B | A | A |
| 75 | 130 | 210 | B | A | A |
| Example: | | | | | |
| 76 | 110 | 180 | A | A | B |
| 77 | 110 | 180 | A | B | B |
| 78 | 110 | 170 | A | A | B |
| 79 | 150 | 200 | B | A | A |
| 80 | 140 | 180 | A | A | A |
| 81 | 120 | 200 | A | A | A |
| 82 | 120 | 220 | A | A | A |
| 83 | 130 | 190 | A | A | A |
| 84 | 120 | 210 | A | A | A |

TABLE 3(B)-continued

| | Fixing temperature range | | | | |
|---|---|---|---|---|---|
| | Fixing start temp. (° C.) | Offsetting temp. (° C.) | OHP transparency | light-fastness | Anti-blocking properties |
| Comparative Example: | | | | | |
| 10 | 160 | 230 | C | A | A |
| 11 | 110 | 140 | A | A | C |
| 12 | 120 | 210 | B | B | A |
| Example: | | | | | |
| 85 | 110 | 170 | A | A | B |

What is claimed is:

1. A magenta toner comprising a binder resin, a colorant and a wax, said magenta toner having a storage elastic modulus at a temperature of 80° C., $G'_{80}$, in the range of from $1\times10^6$ dN/m$^2$ to $1\times10^8$ dN/m$^2$ and a storage elastic modulus at a temperature of from 120° C. to 180° C., $G'_{120\text{-}180}$, in the range of from $2\times10^3$ dN/m$^2$ to $1\times10^6$ dN/m$^2$;

said binder resin containing a hybrid resin having a polyester unit and a vinyl copolymer unit;

said colorant containing i) a compound selected from the group consisting of compounds represented by the following Formulas (1) and (2) and ii) a compound represented by the following Formula (3-1):

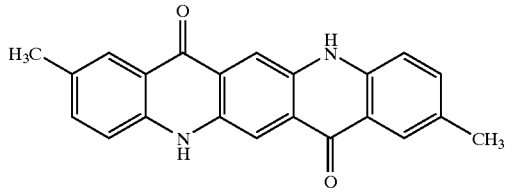

wherein $R_D2$ represents H or $OCH_3$, $R_D4$ represents H or $CONH_2$, $R_D5$ represents H, $SO_2N(C_2H_5)_2$, $CONHC_6H_5$, $CONH_2$ or $CONHC_6H_4$-(p)$CONH_2$, $R_K2$ represents H, $OCH_3$, $CH_3$ or $OC_2H_5$, $R_K4$ represents H, $OCH_3$ or Cl, and $R_K5$ represents H, $OCH_3$, Cl or $NO_2$;

(2)

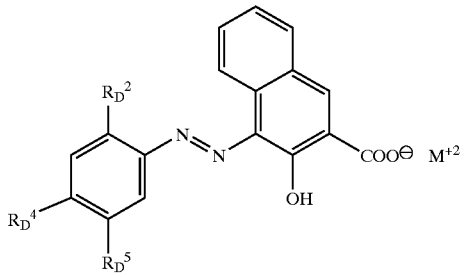

wherein $R_D2$ represents H or $SO_3$—, $R_D4$ represents H, Cl or $CH_3$, $R_D5$ represents H, Cl, $CH_3$, $C_2H_5$, or $SO_3$—, and M represents Ba, Ca, Sr, Mn or Mg; provided that one of $R_D2$ and $R_D5$ is $SO_3$—;

(3-1)

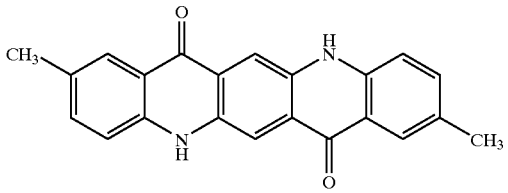

said colorant being contained in an amount of from 2 to 15 parts by weight based on 100 parts by weight of said binder resin; and said wax being contained in an amount of from 0.1 to 20 parts by weight based on 100 parts by weight of said binder resin.

2. The magenta toner according to claim 1, which is a toner containing said compound represented by Formula (1).

3. The magenta toner according to claim 2, which has, in the endothermic curve in the measurement by differential thermal analysis, one or a plurality of endothermic peak(s) in the range of temperature of from 30° C. to 200° C., and a peak temperature of the maximum endothermic peak in the endothermic peaks, in the range of from 60 to 110° C.

4. The magenta toner according to claim 2, wherein said compound represented by Formula (1) and said compound represented by Formula (3-1) are contained in a proportion of from 5:95 to 70:30 in weight ratio.

5. The magenta toner according to claim 2, wherein said compound represented by Formula (1) is a pigment represented by the following Formula (1-1):

(1-1)

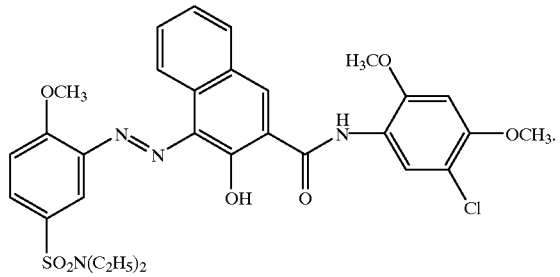

6. The magenta toner according to claim 2, wherein said compound represented by Formula (1) is a pigment represented by the following Formula (1-2):

(1-2)

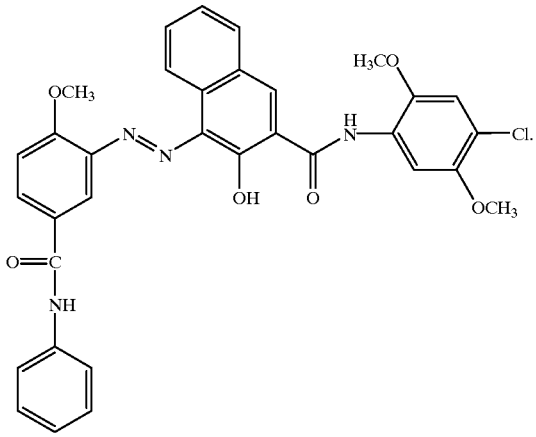

7. The magenta toner according to claim 2, wherein said compound represented by Formula (1) is a pigment represented by the following Formula (1-3):

(1-3)

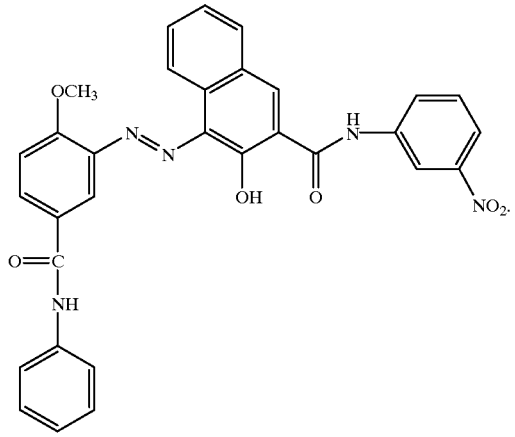

8. The magenta toner according to claim 2, wherein said compound represented by Formula (1) is a pigment represented by the following Formula (1-4):

(1-4)

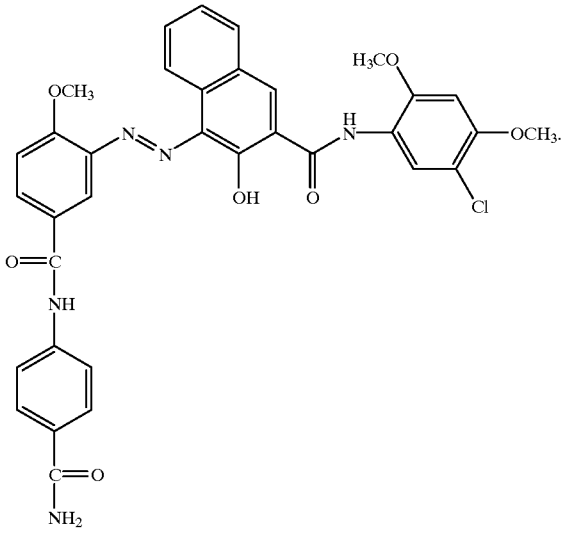

9. The magenta toner according to claim 2, wherein said compound represented by Formula (1) is a pigment represented by the following Formula (1-5):

(1-5)

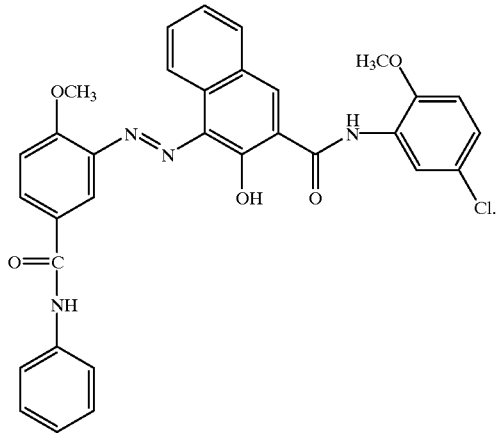

10. The magenta toner according to claim 2, wherein the storage elastic modulus at a temperature of 80° C., $G'_{80}$, is in the range of from $1\times10^6$ dN/m$^2$ to $9\times10^7$ dN/m$^2$ and the storage elastic modulus at a temperature of from 120° C. to 180° C., $G'_{120\text{-}180}$, is in the range of from $5\times10^3$ dN/m$^2$ to $1\times10^6$ dN/m$^2$.

11. The magenta toner according to claim 2, wherein the storage elastic modulus at a temperature of 80° C., $G'_{80}$, is in the range of from $2\times10^6$ dN/m$^2$ to $9\times10^7$ dN/m$^2$.

12. The magenta toner according to claim 2, which has a storage elastic modulus at a temperature of 120° C., $G'_{120}$, in the range of from $1\times10^4$ dN/m$^2$ to $8\times10^5$ dN/m$^2$.

13. The magenta toner according to claim 2, which has a storage elastic modulus at a temperature of 180° C., $G'_{180}$, in the range of from $5\times10^{3}$ dN/m$^2$ to $5\times10^5$ dN/m$^2$.

14. The magenta toner according to claim 2, wherein the storage elastic modulus at a temperature of from 120° C. to 180° C., $G'_{120\text{-}180}$, has a minimum value G'min and a maximum value G'max in a ratio G'max/G'min of 20 or lower.

15. The magenta toner according to claim 2, which comprises a metallic compound of an aromatic carboxylic acid derivative.

16. The magenta toner according to claim 15, wherein said metallic compound of an aromatic carboxylic acid derivative is an aluminum compound of an aromatic carboxylic acid derivative.

17. The magenta toner according to claim 2, which has a weight-average particle diameter of from 4 μm to 10 μm.

18. The magenta toner according to claim 1, which is a toner containing said compound represented by Formula (2).

19. The magenta according to claim 18, which has in the endothermic curve in the measurement by differential thermal analysis, one or a plurality of endothermic peak(s) in the range of temperature of from 30° C. to 200° C., and a peak temperature of the maximum endothermic peak in the endothermic peaks, in the range of from 60 to 110° C.

20. The magenta toner according to claim 18, wherein said compound represented by Formula (2) and said compound represented by Formula (3-1) are contained in a proportion of from 5:95 to 70:30 in weight ratio.

21. The magenta toner according to claim 18, wherein said compound represented by Formula (2) is a pigment represented by the following Formula (2-1):

(2-1)

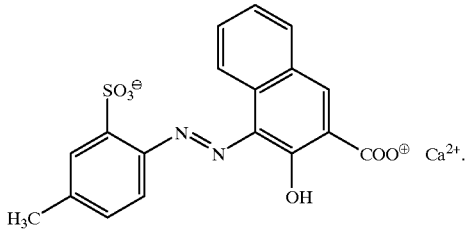

22. The magenta toner according to claim 18, wherein the storage elastic modulus at a temperature of 80° C., $G'_{80}$, is in the range of from $1\times10^6$ dN/m$^2$ to $9\times10^7$ dN/m$^2$ and the storage elastic modulus at a temperature of from 120° C. to 180° C., $G'_{120\text{-}180}$, is in the range of from $5\times10^3$ dN/m$^2$ to $1\times10^6$ dN/m$^2$.

23. The magenta toner according to claim 18, wherein the storage elastic modulus at a temperature of 80° C., $G'_{80}$, is in the range of from $2\times10^6$ dN/m$^2$ to $9\times10^7$ dN/m$^2$.

24. The magenta toner according to claim 18, which has a storage elastic modulus at a temperature of 120° C., $G'_{120}$, in the range of from $1\times10^4$ dN/m$^2$ to $8\times10^5$ dN/m$^2$.

25. The magenta toner according to claim 18, which has a storage elastic modulus at a temperature of 180° C., $G'_{180}$, in the range of from $5\times10^3$ dN/m$^2$ to $5\times10^5$ dN/m$^2$.

26. The magenta toner according to claim 18, wherein the storage elastic modulus at a temperature of from 120° C. to 180° C., $G'_{120\text{-}180}$, has a minimum value G'min and a maximum value G'max in a ratio G'max/G'min of 20 or lower.

27. The magenta toner according to claim 18, which comprises a metallic compound of an aromatic carboxylic acid derivative.

28. The magenta toner according to claim 27, wherein said metallic compound of an aromatic carboxylic acid derivative is an aluminum compound of an aromatic carboxylic acid derivative.

29. The magenta toner according to claim 18, which has a weight-average particle diameter of from 4 $\mu$m to 10 $\mu$m.

30. A magenta toner comprising a binder resin and a colorant;

said magenta toner having a storage elastic modulus at a temperature of 80° C., $G'_{80}$, in the range of from $1\times10^6$ dN/m$^2$ to $1\times10^8$ dN/m$^2$ and a storage elastic modulus at a temperature of from 120° C. to 180° C., $G'_{120\text{-}180}$, in the range of from $2\times10^3$ dN/m$^2$ to $1\times10^6$ dN/m$^2$; and containing i) a compound represented by the following Formula (1) and ii) a compound represented by the following Formula (3-2):

(1)

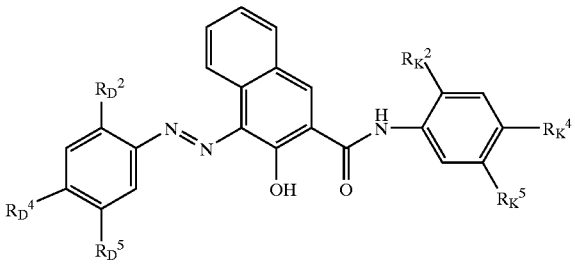

wherein $R_D2$ represents H or $OCH_3$, $R_D4$ represents H or $CONH_2$, $R_D5$ represents H, $SO_2N(C_2H_5)_2$, $CONHC_6H_5$, $CONH_2$ or $CONHC_6H_4$-(p)$CONH_2$, $R_K2$ represents H, $OCH_3$, $CH_3$ or $OC_2H_5$, $R_K4$ represents H, $OCH_3$ or Cl, and $R_K5$ represents H, $OCH_3$, Cl or $NO_2$ (3-2)

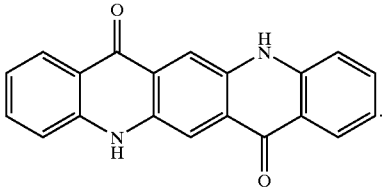

31. The magenta toner according to claim 30, which further comprises a wax.

32. The magenta toner according to claim 31, which has, in the endothermic curve in the measurement by differential thermal analysis, one or a plurality of endothermic peak(s) in the range of temperature of from 30° C. to 200° C., and a peak temperature of the maximum endothermic peak in the endothermic peaks, in the range of from 60 to 110° C.

33. The magenta toner according to claim 30, wherein said compound represented by Formula (1) and said compound represented by Formula (3-2) are contained in a proportion of from 5:95 to 70:30 in weight ratio.

34. The magenta toner according to claim 30, wherein said compound represented by Formula (1) is a pigment represented by the following Formula (1-1):

(1-1)

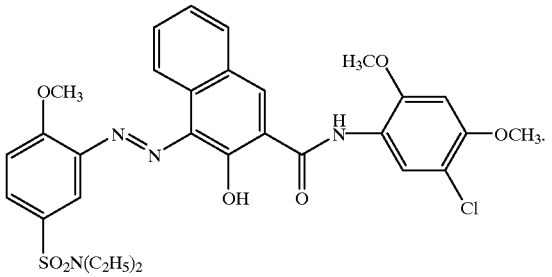

35. The magenta toner according to claim 30, wherein said compound represented by Formula (1) is a pigment represented by the following Formula (1-2):

(1-2)

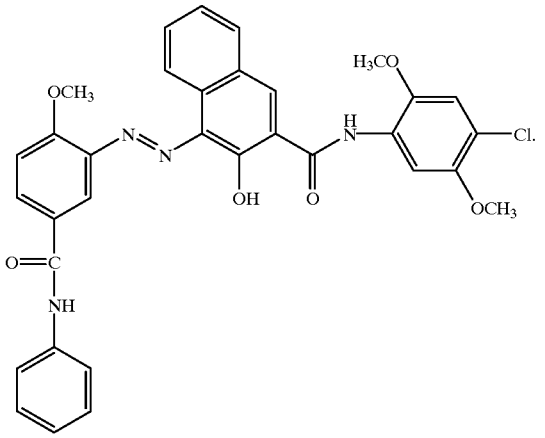

36. The magenta toner according to claim 30, wherein said compound represented by Formula (1) is a pigment represented by the following Formula (1-3):

(1-3)

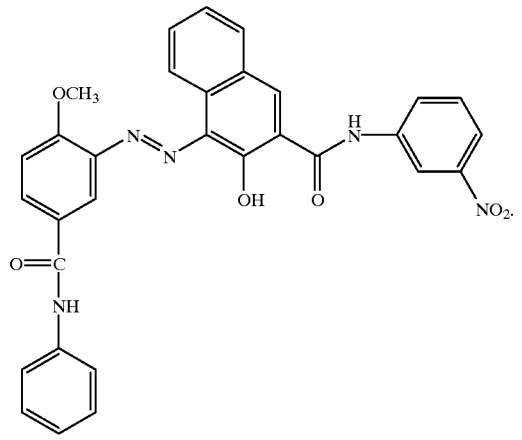

37. The magenta toner according to claim 30, wherein said compound represented by Formula (1) is a pigment represented by the following Formula (1-4):

(1-4)

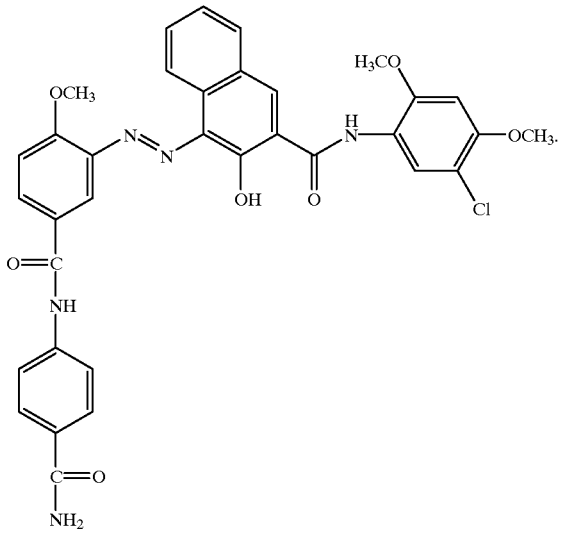

38. The magenta toner according to claim 30, wherein said compound represented by Formula (1) is a pigment represented by the following Formula (1-5):

(1-5)

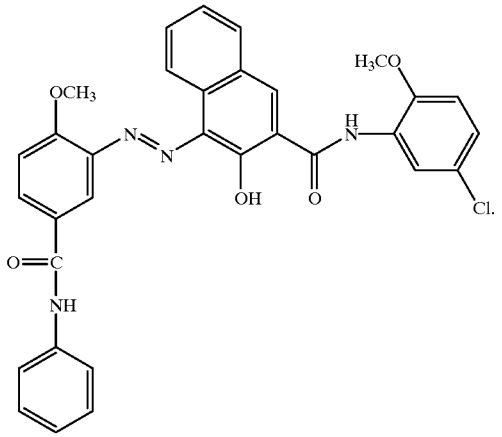

39. The magenta toner according to claim 30, wherein the storage elastic modulus at a temperature of 80° C., $G'_{80}$, is in the range of from $1\times10^6$ dN/m$^2$ to $9\times10^7$ dN/m$^2$ and the storage elastic modulus at a temperature of from 120° C. to 180° C., $G'_{120\text{-}180}$, is in the range of from $5\times10^3$ dN/m$^2$ to $1\times10^6$ dN/m$^2$.

40. The magenta toner according to claim 30, wherein the storage elastic modulus at a temperature of 80° C., $G'_{80}$, is in the range of from $2\times10^6$ dN/m$^2$ to $9\times10^7$ dN/m$^2$.

41. The magenta toner according to claim 30, which has a storage elastic modulus at a temperature of 120° C., $G'_{120}$, in the range of from $1\times10^4$ dN/m$^2$ to $8\times10^5$ dN/m$^2$.

42. The magenta toner according to claim 30, which has a storage elastic modulus at a temperature of 180° C., $G'_{180}$, in the range of from $5\times10^3$ dN/m$^2$ to $5\times10^5$ dN/m$^2$.

43. The magenta toner according to claim 30, wherein the storage elastic modulus at a temperature of from 120 °C. to 180° C., $G'_{120\text{-}180}$, has a minimum value G'min and a maximum value G'max in a ratio G'max/G'min of 20 or lower.

44. The magenta toner according to claim 30, which comprises a metallic compound of an aromatic carboxylic acid derivative.

45. The magenta toner according to claim 44, wherein said metallic compound of an aromatic carboxylic acid derivative is an aluminum compound of an aromatic carboxylic acid derivative.

46. The magenta toner according to claim 30, wherein said binder resin is a resin selected from the group consisting of (a) a polyester resin, (b) a hybrid resin having a polyester unit and a vinyl copolymer unit, (c) a mixture of the hybrid resin and a vinyl copolymer and (d) a mixture of the hybrid resin and the polyester resin.

47. The magenta toner according to claim 30, which has a weight-average particle diameter of from 4 $\mu$m to 10 $\mu$m.

48. A magenta toner comprising a binder resin and a colorant, said magenta toner having a storage elastic modulus at a temperature of 80° C., $G'_{80}$, in the range of from $1\times10^6$ dN/m$^2$ to $1\times10^8$ dN/m$^2$ and a storage elastic modulus at a temperature of from 120° C. to 180° C., $G'_{120\text{-}180}$, in the range of from $2\times10^3$ dN/m$^2$ to $1\times10^6$ dN/m$^2$; and containing i) a compound represented by the following Formula (2) and ii) a compound represented by the following Formula (3-2):

(2)

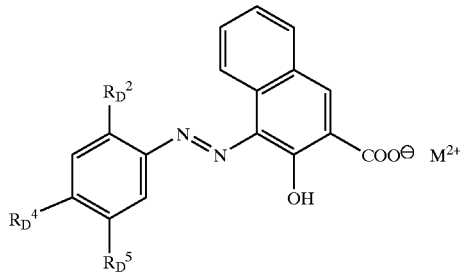

wherein $R_D2$ represents H or $SO_3$—, $R_D4$ represents H, Cl or $CH_3$, $R_D5$ represents H, Cl, $CH_3$, $C_2H_5$, or $SO_3$—, and M represents Ba, Ca, Sr, Mn or Mg; provided that one of $R_D2$ and $R_D5$ is $SO_3$—;

(3-2)

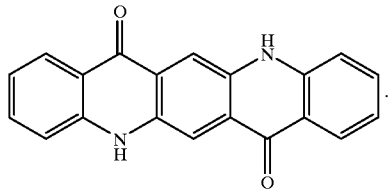

49. The magenta toner according to claim 48, which further comprises a wax.

50. The magenta toner according to claim 49, which has, in the endothermic curve in the measurement by differential thermal analysis, one or a plurality of endothermic peak(s) in the range of temperature of from 30° C. to 200° C., and a peak temperature of the maximum endothermic peak in the endothermic peaks, in the range of from 60 to 110° C.

51. The magenta toner according to claim 48, wherein said compound represented by Formula (2) and said compound represented by Formula (3-2) are contained in a proportion of from 5:95 to 70:30 in weight ratio.

52. The magenta toner according to claim 48, wherein said compound represented by Formula (2) is a pigment represented by the following Formula (2-1):

(2-1)

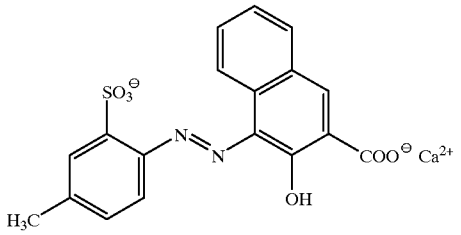

53. The magenta toner according to claim 48, wherein the storage elastic modulus at a temperature of 80° C., $G'_{80}$, is in the range of from $1\times10^6$ dN/m$^2$ to $9\times10^7$ dN/m$^2$ and the storage elastic modulus at a temperature of from 120° C. to 180° C., $G'_{120\text{-}180}$, is in the range of from $5\times10^3$ dN/m$^2$ to $1\times10^6$ dN/m$^2$.

54. The magenta toner according to claim 48, wherein the storage elastic modulus at a temperature of 80° C., $G'_{80}$, is in the range of from $2\times10^6$ dN/m$^2$ to $9\times10^7$ dN/m$^2$.

55. The magenta toner according to claim 48, which has a storage elastic modulus at a temperature of 120° C., $G'_{120}$, in the range of from $1\times10^4$ dN/m$^2$ to $8\times10^5$ dN/m$^2$.

56. The magenta toner according to claim 48, which has a storage elastic modulus at a temperature of 180° C., $G'_{180}$, in the range of from $5\times10^3$ dN/m$^2$ to $5\times10^5$ dN/m$^2$.

57. The magenta toner according to claim 48, wherein the storage elastic modulus at a temperature of from 120° C. to 180° C., $G'_{120\text{-}180}$, has a minimum value G'min and a maximum value G'max in a ratio G'max/G'min of 20 or lower.

58. The magenta toner according to claim 48, which comprises a metallic compound of an aromatic carboxylic acid derivative.

59. The magenta toner according to claim 58, wherein said metallic compound of an aromatic carboxylic acid derivative is an aluminum compound of an aromatic carboxylic acid derivative.

60. The magenta toner according to claim 48, wherein said binder resin is a resin selected from the group consisting of (a) a polyester resin, (b) a hybrid resin having a polyester unit and a vinyl copolymer unit, (c) a mixture of the hybrid resin and a vinyl copolymer and (d) a mixture of the hybrid resin and a polyester resin.

61. The magenta toner according to claim 48, which has a weight-average particle diameter of from 4 $\mu$m to 10 $\mu$m.

* * * * *

UNITED STATES PATENT AND TRADEMARK OFFICE

CERTIFICATE OF CORRECTION

PATENT NO. : 6,664,016 B2 
DATED : December 16, 2003
INVENTOR(S) : Makoto Kanbayashi et al.

It is certified that error appears in the above-identified patent and that said Letters Patent is hereby corrected as shown below:

Title page,
Item [57], ABSTRACT,
Line 15, "$SO_3$" should read -- $SO_3$ –. --.

Column 4,
Line 20, "off" should read -- of --; and
Line 23, "at least" (second occurrence) should be deleted.

Column 26,
Line 26, "(w))" should read -- (w) --.

Column 37,
Line 25, "a*-70.8," should read -- a*=70.8, --.

Column 45,
Line 34, "a*-73.2," should read -- a*=73.2, --.

Column 48,
Line 24, "3.8 μmin" should read -- 3.8 μm in --.

Column 57,
Lines 35-41, "

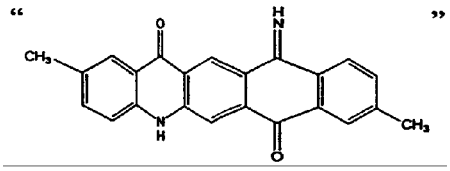

" should read

--

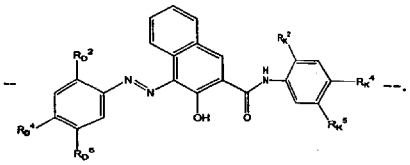

--.

UNITED STATES PATENT AND TRADEMARK OFFICE

CERTIFICATE OF CORRECTION

PATENT NO. : 6,664,016 B2 
DATED : December 16, 2003
INVENTOR(S) : Makoto Kanbayashi et al.

It is certified that error appears in the above-identified patent and that said Letters Patent is hereby corrected as shown below:

Column 58,
Lines 20-29, "

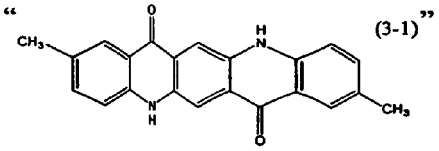

(3-1)" should read

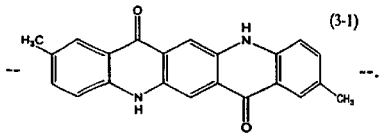

(3-1)

-- --.

Column 60,
Line 55, "has" should read -- has --.

Column 62,
Line 3, "$NO_2$" should read -- $NO_2$; --.

Column 64,
Line 33, "colorant," should read -- colorant; --.

Signed and Sealed this

Twenty-fourth Day of August, 2004

JON W. DUDAS
*Director of the United States Patent and Trademark Office*